US006082007A

United States Patent [19]

Andrews

[11] Patent Number: 6,082,007

[45] Date of Patent: Jul. 4, 2000

[54] IN-LINE BI-DIRECTIONAL MANUAL SHAVING RAZORS

[76] Inventor: Edward A. Andrews, 6835 Beach Rd., Troy, Mich. 48098

[21] Appl. No.: 09/326,190

[22] Filed: Jun. 6, 1999

Related U.S. Application Data

[63] Continuation-in-part of application No. 09/241,975, Feb. 1, 1999, and application No. 08/739,990, Oct. 29, 1996, Pat. No. 5,979,056, which is a continuation-in-part of application No. 08/739,364, Oct. 28, 1996, Pat. No. 5,983,499, which is a continuation-in-part of application No. 08/473,473, Jun. 7, 1995, Pat. No. 5,568,688, said application No. 09/241,975, is a continuation-in-part of application No. 08/653,515, May 24, 1996, Pat. No. 5,856,189, which is a division of application No. 08/301,255, Sep. 6, 1994, Pat. No. 5,522,137, which is a continuation-in-part of application No. 08/020,594, Feb. 22, 1993, Pat. No. 5,343,622.

[51] Int. Cl.[7] ..... B26B 21/10; B26B 21/16; B26B 21/22

[52] U.S. Cl. ..... 30/50; 30/47; 30/51; 30/53

[58] Field of Search ..... 30/32, 47, 49, 30/50, 51, 53

[56] References Cited

U.S. PATENT DOCUMENTS

| | | | |
|---|---|---|---|
| D. 343,922 | 2/1994 | Ahlgren . | |
| 839,447 | 12/1906 | Arnold . | |
| 1,044,906 | 11/1912 | Ohlsson . | |
| 1,217,288 | 2/1917 | Donnelly . | |
| 1,229,824 | 6/1917 | Tewelow . | |
| 1,835,655 | 12/1931 | Lehmann | 30/53 |
| 1,976,290 | 10/1934 | Motley . | |
| 2,547,376 | 4/1951 | Crawford . | |
| 2,794,246 | 6/1957 | Marsh et al. | 30/32 |
| 2,952,910 | 9/1960 | Meohas . | |
| 3,109,237 | 11/1963 | Girouard . | |
| 3,488,764 | 1/1970 | Welsh . | |
| 3,571,927 | 3/1971 | Stone | 30/51 |
| 3,777,396 | 12/1973 | Simonetti . | |
| 4,213,240 | 7/1980 | Ferraro et al. | 30/47 |
| 4,285,125 | 8/1981 | Chen et al. . | |
| 4,378,635 | 4/1983 | Burch . | |
| 4,501,066 | 2/1985 | Sceberras . | |

(List continued on next page.)

FOREIGN PATENT DOCUMENTS

| | | |
|---|---|---|
| 52-15761 | 2/1977 | Japan . |
| 273152 | 6/1927 | United Kingdom . |

*Primary Examiner*—Hwei-Siu Payer
*Attorney, Agent, or Firm*—Harness, Dickey & Pierce, PLC

[57] ABSTRACT

In-line razor-blade shaving devices feature two sets of razor blade strips pointing outwardly in opposite directions. The devices are designed for safely and rapidly shaving hair from large body portions such as legs and arms. Each device features an elongated handle arranged in line with an elongated bi-directional razor blade head. Each set of razor blade strips in the head may be provided with one or more straight razor-sharp edges, which point in the same direction, while the blade edges of the two sets point outwardly away from one another, generally in opposite directions. The edges of blade strips of the two sets may be arranged in one common working plane, or each set may be in its own working plane, with the planes at an angle to one another. The working planes are defined by the elongated front and rear guard surfaces of the blade-edge guarding system on the face of the razor head. These guard surfaces contact a user's skin before and after the razor-sharp edges to help ensure safe shaving. The bi-directional head may be constructed in a variety of ways, including in a molded form, in an assembled form, as a replaceable bi-directional cartridge, and as two separate uni-directional razor blade heads arranged in close proximity to one another. These in-line bi-directional razor blade shaving devices represent a new family of wet shaving razor devices. They each can be used with a minimum of effort by sliding the razor blade head back and forth along the skin to be shaved, with shaving occurring in both directions. Some embodiments have two distinct working planes on the head of the shaving device. To use them, the user's wrist rotates at the end of each stroke (or at the beginning of the next stroke), to bring the other working plane, not currently on the skin, into engagement with the skin for the next stroke in the opposite direction.

34 Claims, 6 Drawing Sheets

U.S. PATENT DOCUMENTS

| | | | |
|---|---|---|---|
| 4,603,477 | 8/1986 | Francis . | |
| 4,622,742 | 11/1986 | Lee . | |
| 4,791,724 | 12/1988 | Dumas . | |
| 4,831,731 | 5/1989 | Eltis . | |
| 4,976,030 | 12/1990 | Boyd . | |
| 5,084,968 | 2/1992 | Trotta . | |
| 5,133,131 | 7/1992 | Hoffman . | |
| 5,287,624 | 2/1994 | Mondo et al. . | |
| 5,343,622 | 9/1994 | Andrews . | |
| 5,426,853 | 6/1995 | McNinch . | |
| 5,479,950 | 1/1996 | Andrews | 30/32 |
| 5,522,137 | 6/1996 | Andrews | 30/50 |
| 5,579,580 | 12/1996 | Althaus et al. . | |
| 5,865,189 | 2/1999 | Andrews . | |
| 5,934,291 | 8/1999 | Andrews | 30/32 |

262
252
254
250
264
266
269
256
251
253
258
255
259
268
248
240
242
247
243

265
15
15
264
266
253
14
14
256
248
247
164
243

248
278
243
242
277
247

252
254

258
257
278
260
261
255
263
270
264
277
259
257

IN-LINE BI-DIRECTIONAL MANUAL SHAVING RAZORS

CROSS-REFERENCE TO RELATED APPLICATIONS

This application is a continuation-in-part of application Ser. No. 09/241,975 filed Feb. 1, 1999, which is a continuation-in-part of application Ser. No. 08/653,515 filed May 24, 1996, now U.S. Pat. No. 5,856,189 issued Feb. 2, 1999, which is a division of application Ser. No. 08/301,255 filed Sep. 6, 1994, now U.S. Pat. No. 5,522,137 issued Jun. 4, 1996, which is a continuation-in-part of application Ser. No. 08/020,594 filed Feb. 22, 1993, now U.S. Pat. No. 5,343,622. This application is also a continuation-in-part of application Ser. No. 08/739,990 filed Oct. 29, 1996, now U.S. Pat. No. 5,979,056 which is a continuation-in-part of application Ser. No. 08/739,364 filed Oct. 28, 1996, now U.S. Pat. No. 5,983,499 which is a continuation-in-part of application Ser. No. 08/473,473 filed Jun. 7, 1995, now U.S. Pat. No. 5,568,688. The entire disclosures of these prior applications are hereby incorporated by reference herein.

FIELD OF THE INVENTION

The present invention relates in general to manual shaving devices employing at least one elongated straight razor blade arranged in-line with an elongated handle, and in particular to bi-directional manual shaving devices employing an elongated razor blade head, with two sets of outwardly-pointing straight-edge razor blade strips shielded by a blade-edge guarding system, mounted on an in-line handle for safely and rapidly shaving large areas of skin in two opposite directions that are generally perpendicular to the main axes of the in-line handle and razor head.

BACKGROUND OF THE INVENTION

Uni-directional razor blade shaving devices have long been known, starting with the old straight-edge razor with an in-line handle used by barbers more than a century ago. In more recent times, most personal shaving has been done by individuals rather than by barbers. Further, the predominant forms of manual wet-shaving devices over at least the last five decades have been based upon the classic T-bar razor, with its elongated razor head and a handle which extends perpendicularly from the bottom of the razor's blade head.

In more recent decades, the quality of the T-bar razor blade head has improved, while its cost has been lowered and user safety increased. The modern wet-shaving razor features an angled T-bar handle and an elongated razor head having a blade-edge guarding system located about the razor-sharp edges to minimize the possibility of nicks and cuts, which were a problem with older T-bar razor designs, especially for an inexperienced user. Modern safety razor blade heads now feature front and rear elongated guards which establish a common working plane in which the razor-sharp edges of twin parallel razor blade strips are disposed. In this manner, the sharpened blade edges are only exposed by a few thousandths of an inch above the working plane, which helps minimize nicks and cuts. The angled neck on the T-bar handle also helps by making it easier for the user to grip the handle comfortably while holding the razor head at an angle so that the working plane or face of the razor will lay flat against the skin to be shaved.

To further minimize nicks and to more readily allow the razor-sharp blade edges to follow the curving contour of a user's skin, some of the more advanced uni-directional razor blade heads now pivot or rotate while pressed lightly against the user's skin. Also, they often have spring-loaded razor blade strips that move with the undulations in the skin, or have heads that flex. Examples of such movable razor blade heads in commercial use and also which are available in a replaceable cartridge style, include the wet-shaving manual shaving razors distributed by the Gillette Company of Boston, Mass., U.S.A. under the Sensor®, the Sensor Excel®, the Sensor for Women™, and the Mach3™ brand names. Also, a number of flexible uni-directional razor blade head designs have been made. Examples in commercial use, that are available in a replaceable cartridge-style, include the wet shaving razors distributed by the Warner-Lambert Company of Morris Plains, N.J., U.S.A. under the Schick Tracer® and Lady Schick® brand names.

In an effort to advance the safety and efficacy of the wet-shaving art, I developed single-head bi-directional wet-shaving devices which are disclosed in my first three earlier patents cited in the first paragraph of this specification. In spite of all of this development, there is still a real need for easy-to-use bi-directional shaving devices specifically designed to rapidly shave large body areas, including the arms and legs. This is an important task which is undertaken millions of times a day by women who shave their legs. It is also performed regularly by those in the medical community who shave patients for surgery or other treatments, by those in the athletic community (e.g., swimmers, wrestlers, body builders, etc.), and by caretakers who shave those who cannot shave themselves. There is a continuing need for improved manual shaving devices to perform these large-body shaving tasks.

Objects. In light of the foregoing needs, it is desirable to provide still further improvements in bi-directional razor blade systems, structures and cartridges to allow a user to shave large areas of skin on the body, such as the legs and arms, rapidly and safely. With this in mind, I have created a new family of bi-directional razor blade shaving devices, called in-line bi-directional shaving devices, which can be separated into several classes. Each of these in-line shaving devices achieves one and usually several of the following objectives of the present invention.

A first major object of this invention is to provide several different in-line single-head razor devices, each with an elongated head and handle, which can each be used for rapidly and safely shaving large body areas in two opposite directions generally perpendicular to the major axes of the head and handle. It is a related object to arrange the handle and head relative to one another so that this task of shaving large body areas bi-directionally can be accomplished in an entirely natural, completely comfortable, and easy-to-use way.

A second major object is to provide compact in-line bi-directional razor blade devices, with the elongated head and handle arranged generally in-line, which are easier to use than present-day uni-directional T-bar razor devices to rapidly shave the legs and arms or other large body areas.

A third object is to provide for several different constructions of a bi-directional straight razor blade cartridge for an in-line razor shaving device, which cartridges can be manually removed from the in-line razor handle and replaced with a fresh cartridge whenever the blades become dull or the user wishes to do so.

A fourth object is to provide an improved method of manual shaving large area body surfaces, namely bi-directional shaving using an in-line razor shaving device having an elongated handle for supporting a single bi-directional razor head generally in-line with the principal axis of the handle, where the user's handgrip on the razor's handle need not be changed as the bi-directional razor head is moved back and forth in opposite directions to shave an area of skin. A related object is to provide a method of shaving using in-line bi-directional razor devices which does not require any significant lifting, tilting or repositioning of the bi-directional razor head relative to the skin, and which substantially reduces the time and effort spent shaving.

A fifth object of the present invention is to provide an in-line wet shaving razor device that will more readily deliver a closer shave than conventional uni-directional dual-blade wet razor systems, by virtue of facilitating shaving the same area of skin from two opposite directions. A related object is to help prepare and condition the skin to be shaved by scraping it with one or two razor blade edges moving in a non-cutting direction, and/or by stretching it out by using front and rear guards which grip and/or smooth the skin from two directions.

A sixth object is to provide an in-line wet shaving razor device that stays sharper longer than a conventional uni-directional razor blade system by virtue of having twice as many shaving edges, and by having flow-through debris passages which allow a user to easily rinse away shaving debris that might otherwise remain on and eventually dull the blade strip edges.

A seventh object is to provide several different constructions of in-line bi-directional razor shaving devices which are particularly economical to manufacture at a cost essentially equal to or slightly more than conventional uni-directional razors.

An eighth object is to provide several different constructions of in-line bi-directional razor shaving devices which are economical to manufacture using a combined handle and razor made from a single elongated piece of molded plastic.

A ninth object is to provide single-head in-line bi-directional razor blade shaving devices wherein two sets of opposed blade strips both make effective use of a single rear guard/lubricant strip centrally located between them.

A tenth object of the present invention is to provide a first class of in-line bi-directional razor shaving devices which have all of the razor-sharp edges of the blade strips arranged in substantially the same working plane in a single head, and which need not be lifted, tilted or turned while speed-shaving in two opposite directions.

An eleventh object is to provide a second class of in-line bi-directional razor blade shaving devices, each having a single head with two sets of razor blade strips, with each set being located in its own working plane that faces away from and intersects the other pair's working plane at an angle in the range of about five degrees up to about fifteen or so degrees, so that the in-line shaving devices need not be lifted or deliberately tilted or turned while speed-shaving in two opposite directions.

A twelfth object is to provide a third class of in-line bi-directional razor blade shaving devices, each having a single head with two sets of razor blade strips, with each set being located in its own working plane facing away from the other working plane, with the two working planes intersecting one another at an angle of about twenty degrees or more, so that the in-line devices must be deliberately tilted and turned at the end of each stroke (or at the beginning of the next stroke) to engage the other working plane for the next stroke in the opposite direction.

Still other objects and advantages of the present invention will become apparent from the Summary and the Detailed Description of the Preferred Embodiments of the present invention which follow.

SUMMARY OF THE INVENTION

In response to the above-referenced needs, I envisioned the above-stated objects. I also recognized that it would be desirable if these needs could be met with devices that could be manufactured using conventional elongated razor blade strips with straight razor-sharp edges packaged into a new kind of manual shaving device. I also recognized that it would be advantageous if my earlier bi-directional razor blade structures disclosed in my first three patents cited above as being used with a T-bar handle, could somehow be adapted to the task of rapidly shaving large body areas.

The foregoing needs are met, and the foregoing objects are achieved, by the various embodiments of the in-line bi-directional shaving devices of my present invention. Most embodiments achieve several of the objects stated above. In accordance with a first aspect of my invention, there is disclosed herein an in-line bi-directional shaving device that has a single-head structure with outwardly-pointing razor-sharp blade edges. By "in-line" I mean a head structure that is connected to and supported by a handle structure, where the two structures have their respective principal axes generally arranged in a common plane. This arrangement for an in-line razor blade shaving device that features a bi-directional razor blade head allows a user to speed-shave large skin areas of the body, such as the legs and arms. The bi-directional head is preferably equipped with a blade-edge guarding system, for each set of sharpened razor blade edges, that establishes one or two working planes in which the razor-sharp edges are disposed.

This bi-directional razor blade device is preferably comprised of an elongated bi-directional razor head structure connected to and supported by an elongated in-line handle structure. The head and handle each have a principal axis, and each axis is located in a common central plane, which I sometimes call a plane of symmetry, since the head and handle are both preferably symmetrically arranged about this plane. The device also includes at least first and second elongated razor blade strips supported by the head, each strip having a sharpened blade edge portion extending outwardly generally away from the sharpened edge portion of the other strip. The bi-directional razor head structure also has a blade-edge guarding system provided with: (a) first and second front guard portions spaced from to one another and respectively including first and second longitudinal edges, preferably parallel to one another, which define a common reference plane; and (b) preferably has first and second end portions extending generally transversely to the central longitudinal axis of the razor head. The razor head has a face and a central longitudinal axis located between the longitudinal edges. This elongated razor head is preferably symmetrically arranged about the central plane, which preferably is perpendicular to the common reference plane.

The elongated in-line handle structure has a handgrip portion that is connected to the razor head. The handle structure generally extends outwardly away from the razor head in a direction that maintains the principal axis of the handle structure generally within the plane of symmetry. The handle and head are arranged so that the head is supported for manual movement by the user in two opposite directions generally perpendicular to the axis of the handle.

The sharpened blade edge portions of the first and second elongated razor blade strips each preferably extend outwardly at an acute angle relative to the face of the razor head structure so that they each project generally toward their respective longitudinal edges closest to them and away from the central longitudinal axis of the razor head. The blade edge portions each preferably include a straight elongated razor-sharp edge. The razor-sharp edge of the first blade strip is generally positioned in a first working plane defined in part by the first front guard portion. The razor-sharp edge of the second blade strip is generally positioned in a second working plane defined in part by the second front guard portion, which may be coextensive with the first working plane or may be a separate working plane distinct from and at angle to the first working plane, in those embodiments having two distinct working planes.

The handgrip portion of the razor handle structure is arranged and adapted for manually grasping and for moving the handle structure back and forth in first and second directions opposite from one another that are generally perpendicular to the principal axis of the handle. In this manner, hair extending from the skin is shaved in both directions for a closer shave than shaving in one direction alone normally produces. As the razor head is moved in the first direction along a user's skin, the first working plane of the razor head, formed or defined in part by at least the first front guard portion thereof and a rear guard portion, is normally in tangential contact with the skin, thus helping ensure the sharpened edge of the first razor blade strip is at an optimum acute angle for shaving as it traverses across the skin. Upon a reversal of the direction of movement of the handle structure, the razor head moves in the second direction along a user's skin that is opposite the first direction. As the razor moves in this second direction, the second working plane of the razor head, in which the razor-sharp edge of the second razor blade strip is disposed, which is formed or defined in part by at least the second front guard portion and a rear guard portion, is in tangential contact with the skin, once again helping to ensure an optimum angle for shaving. In the single-plane embodiments of the in-line shaving devices of the present invention (i.e., where the first and second working planes are the same), each front guard may serve if desired as a rear guard for the other front guard. The blade-edge guarding system also includes an elongated rear guard for each active razor blade set.

When using an in-line bi-directional shaving device of the type described above, it is not necessary for the user to lift the elongated razor head from the skin during movements in the opposite directions, although this can be done if desired. Instead, a user of my in-line razor blade device may rapidly slide the bi-directional razor head back and forth along the skin to be shaved, while maintaining at least one of the working planes of razor head generally in continuous contact with the skin during movement in the first or second directions. All of the razor blade shaving devices of the present invention can be so utilized, including reversing them and stroking them back and forth in opposite directions, without paying much attention to lifting or repositioning the razor head relative to the user's skin.

The first and second guards form part of the blade-edge guarding system for the in-line bi-directional razor head. This is made possible by the blade-edge guarding system that provides front and rear elongated guards for each set of razor blades. The blade-edge guarding system has services which are present on the face of the razor head. Since the razor blade strips are pointed in opposite directions, only one half of the razor head may be active, that is cutting hair, at a time. The guards are preferably spaced from each razor-sharp edge of the razor blade strip or strips which they are guarding. In a razor head having a single working plane, the front guard of one active blade set may constitute the rear guard of the other blade set. Alternatively, an elongated central rear guard member may be provided that is common to both razor blade sets. Having a front and rear guard for each active blade set renders it very easy to position the proper working plane and associated active half of the face of the razor blade head against the skin without the need to carefully watch or feel the razor blade head in the process.

According to a second aspect of the present invention, there is provided, as shown in some embodiments of the present invention, a bi-directional razor head that includes two working planes at a distinct angle relative to, and facing away from, one another. In those embodiments, only one working plane at a time can be in contact with the skin, if that distinct angle is larger than about five or ten degrees or so. Accordingly, at the end of each stroke with these in-line devices having two distinct working planes at a substantial angle to one another, a modest twist of the wrist needs to be made to position the other working plane in contact with the skin, just before or as the motion in the opposite direction is started. As further explained below, this form of user control will no doubt be preferred by some shavers.

Among the seven different embodiments of the in-line bi-directional razor shaving devices of the present invention that are disclosed below, and a number have only a single compact elongated razor head structure that can be characterized as follows. The single bi-directional head razor has at least two razor blade strips. The head supports these first and second razor blade strips with their respective sharpened edge portions extending, that is pointing, in generally opposite directions. The elongated razor head preferably has first and second longitudinal edges, and a longitudinal axis centrally located between the longitudinal edges. In those single-head embodiments with only one working plane, the face is generally flat, and is located between the two longitudinal edges. In those single-head embodiments with two distinct working planes, the face is slanted or curved in the center in the vicinity of a centrally-located elongated rear guard which may be provided with a lubricant strip. Thus, these two working plane embodiments each have two distinct half-faces, angled with respect to one another, between the two longitudinal edges. The sharpened blade edge portion of the first razor blade strip extends outwardly at an acute angle relative to the face of the razor head. It projects generally toward the first longitudinal edge of the head and away from the longitudinal axis of the head. Similarly, the second razor blade strip has its sharpened blade edge portion extending outwardly at an acute angle relative to the face. It projects generally toward the second longitudinal edge of the razor head and away from the longitudinal axis. Thus, the sharpened edges of the first and second blades point generally away from one another.

In preferred embodiments of the single-head bi-directional razor of the present invention, two sets of razor blade strips are provided, and all strips are preferably of the same length. While three razor blade strips may be provided in each set, two are believed sufficient, and even one will work. Consider an embodiment with two pairs of razor blade strips. The first and second strips are arranged as described in the preceding paragraph. A third razor blade strip is supported by the head and has a sharpened edge portion that is arranged closely adjacent to and spaced a short distance from the sharpened edge portion of the first blade strip. In this manner, the first and third blade strips form a first pair of razor blade strips that cut hair substantially simultaneously as the razor is moved in a first direction along the user's skin. Similarly, a fourth razor blade strip is arranged closely adjacent to and spaced a short distance from the second blade strip to form a second pair of razor blade strips. The sharpened blade edge portions of this second pair of blade strips cut hair substantially simultaneously as the razor is moved in a second direction opposite from the first direction along the user's skin.

Several distinctly different embodiments of my in-line single-head bi-directional razor with two sets of razor blade strips as generally described above are disclosed. The razor blade strips may be molded into the razor head, or may be part of an assembled head structure that is designed for holding the blade strips fixedly in place or movably in place. Examples of the molded style of construction and of the assembled style of construction are provided in different embodiments presented herein.

As is well known, modern conventional uni-directional safety razors often have a pair of adjacent razor blade strips mounted parallel to one another between a forward guard bar, a rear glide strip or surface, and blade-end caps or shields. This modern style of safety razor construction reduces the chance that the razor blade edges will accidentally nick or cut the skin during shaving. As is well known, the two parallel blade strips have their edges projecting into a working plane of the razor that is also in part defined by the surfaces of the guard bar, glide strip or surface and end caps which contact the user's skin. These non-cutting surfaces of the safety razor, which are in or very near to the working plane of the razor, help ensure that the blade edges are presented to and engage the skin of the user to be shaved at a proper angle so as to minimize the chance of nicks or cuts to the skin.

The in-line bi-directional razors of the present invention are preferably constructed in a manner which incorporates those same advantages found in the modern uni-directional safety razors of the T-bar type. However, the in-line bi-directional razor devices of the present invention need to utilize two front guard bars, one for each of two opposite directions of transverse movement of the razor head across the skin, and preferably include at least one glide strip or sliding surface centrally located between the two sets of blades. These front guards may be pliable, if desired, by using a plurality (such as four or five) of soft parallel micro-fins for each front guard, as is found of the Gillette Sensor Excel and Gillette Mach3 uni-directional razor blade cartridges, or they may be deformable elongated soft foam blocks. The blade-end shields, which may take the form of a pair of end caps or raised end portions on the razor head, are configured to shield the end corners of both sets of blade strips from exposure to the user's skin. Further, the in-line bi-directional razor heads of the present invention are preferably constructed to have a face that is symmetrical about a central longitudinal axis and about a central transverse axis.

According to a third aspect of the present invention, the in-line bi-directional razor heads of the present invention may be constructed as disposable cartridges designed to be used with reusable handles. In one embodiment according to this aspect of the invention, the bi-directional cartridge may be formed of molded plastic material. It is preferably constructed as an elongated, narrow member which is configured to be installed upon an in-line razor handle that may include a head support frame mounted on one end of the handle. The cartridge can thus be removed and replaced with a new cartridge when desired. Pairs of parallel, closely spaced, single edge, strip-type razor blades may be embedded in plastic material, with the plastic molded directly around the lower portion of the blade strips, thus anchoring the blade strips in place.

In yet other embodiments, the cartridge may be provided with a main razor blade support structure that is preferably made of any suitable material, including one or more pre-molded plastic parts. This support structure can be of a rigid design or a flexible design, and preferably includes at least a platform structure a little longer than the length of the razor blade strips, These cartridge structures may also include a cap member. The cartridge normally is assembled, with the blade strips being retained in place therein using any conventional means, such as retaining pins, end caps, or blade-retaining bands. These pins, caps and bands are preferably attached to the support structure or base of the head. In the rigid designs, the blade strips may be rigidly fixed in position, or they may be individually spring-loaded. The spring-loaded blades may be confined to move only up and down generally perpendicularly to the working plane, or they can be confined, so as to be to move back and forth in a direction generally parallel to the working plane. In the flexible designs, the blade strips are allowed to move with head in a direction that is substantially perpendicular to the direction of head travel during use and to the longitudinal axis of the cartridge.

In some embodiments of my bi-directional cartridges, the razor head of the cartridge is rigidly fixed relative to the handle. If desired, embodiments can be provided where the cartridge head pivots or swivels relative to the handle, typically on pivot pins or shell bearings mounted to the bottom side of the razor handle, or a neck or yoke extending from one end of a handle. In such alternative embodiments, the entire bi-directional cartridge may pivot relative to the handle, with a conventional return spring being used to bias it back to a nominal centered position in the absence of external forces.

Still other constructions are possible. For example, other embodiments can be provided where individual uni-directional cartridges which make up one-half of the bi-directional head, and arranged to individually pivot, and/or may be individually equipped with a return-to-center spring, such as the type found in conventional pivoting uni-directional cartridges used on commercially available T-bar wet razors.

In all styles of construction of my in-line bi-directional razors, I prefer to have both sets of sharpened blade edges arranged parallel to the central longitudinal axis of an elongated head, with the first and second set of blade edges pointing in opposite directions. The sharpened edges of the blade strips may point in opposite directions at an obtuse angle relative to each other, while being disposed at an acute angle relative to their own respective working plane within the razor head.

The razor head may be constructed as a disposable cartridge or as a permanent extension of the handle, and it can be made in many different sizes and shapes, as illustrated by the seven embodiments. In still other embodiments I have contemplated (and not shown herein), the razor heads are preferably made to be of a relatively conventional size and shape, and need not differ much in size from common commercially available uni-directional T-bar razor heads. Further, these heads can be used with handles whose hand-grip portion looks very much like conventional commercially available handles used on T-bar razors. If desired, the razor blade strips can be made longer than the usual 35 mm to 38 mm length (1.38" to 1.5"), and can be about 50 mm to 52 mm (about 2") or more long.

Although most of the razor heads of my invention are shown with and contemplate the use of a double pair of razor blade strips, the bi-directional razors of the present invention need not be so complicated. Two single blades that extend in opposite directions, rather than twin-blade pairs, can be used. This style of construction provides a thinner width or profile for the bi-directional razor blade head, so that it could be easily used in the tightest of places to be shaved. A single-blade design having only two opposed razor-sharp edges is simpler still, and may also be used. This double-edged single razor blade approach may be used and extended to most of the other embodiments, by simply removing the third and fourth razor blade strips and eliminating if desired the corresponding portion of the support structure associated with the removed blade strips. In virtually every instance, this could be used to reduce the width of the razor head, if desired.

The in-line bi-directional razor shaving devices of the present invention disclosed herein can be categorized into six general classes, which, in my opinion, will meet the needs and shaving preferences of the many different potential users of my in-line bi-directional razor shaving devices. In a first class of the bi-directional razors, which is exemplified by the first and fourth embodiments and the individual heads of the sixth and seventh embodiments herein, the sharpened edge portions of the first and second sets of blade strips (which point to generally opposite directions) are all arranged in a single common working plane. While these embodiments all have four blade strips, each could be implemented with only two opposed blade strips, if desired, with the sharpened blade edges pointing away from one another and yet being arranged in a common plane.

In a second class of in-line bi-directional razor blade devices according to the present invention, each set of blade edges are in their own separate working plane. This class of in-line bi-directional razor is exemplified by the second and fifth embodiments shown in the Figures. They each have two working planes that intersect one another at an angle of only several degrees, such as from about five or ten degrees to less than about 20 degrees, and preferably in the range of about eight to about fifteen degrees. Since the skin on most large body areas is generally somewhat compliant, this slight difference in angle between the first and second working planes of the razor blade still enables the in-line bi-directional razor to be used in those compliant areas without lifting or noticeably turning or tilting the handle of the razor while moving back and forth in opposite directions. In other words, the bi-directional shaving head normally need not be lifted or deliberately tilted or turned while shaving in two opposite directions. To the extent that any tilting or turning is required, it happens virtually automatically, due to the natural biomechanical motions of a user dragging exposed cutting razor blade strips across the skin to be shaved. In other words, the user's hand and/or wrist will automatically turn or give a little without the user really consciously having to turn either the hand or wrist in order to fully engage the other working plane for the stroke in the opposite direction.

In a third class of in-line single-head bi-directional razor blade shaving devices of the present invention, there are two sets of blade strips, each in their own working plane, with the two working planes being angled considerably more than fifteen degrees from one another, such as about 20 degrees apart, up to about 120 degrees or so apart, with the working planes being arranged to face away from one another. Preferably the angle between the two planes is in the range of about 30 degrees to about 100 degrees, with a narrower range of about 35 degrees to about 90 degrees being presently preferred. This class of in-line bi-directional razors is exemplified by the second, third fourth and fifth embodiments of the present invention. Since the working planes for the two sets of blades are angled so far apart, it is normally not possible for both set of blade edges to cut hair, each in its own direction, while the head and handle both remain in the same relative position to the skin being shaved, since most skin is not that soft or yielding. Accordingly, the user of this class of in-line bi-directional shaving devices must deliberately tilt or turn the handle and thus razor head itself to place the in-line razor head into the two different cutting positions or inclinations. Note that for this (and all other classes of my in-line shaving devices) the handgrip of the user on the handle of the in-line razor shaving device may and preferably does remain the same, as the shaving head is moved back and forth by the user; only the user's wrist need turn.

This third class of my in-line bi-directional razors thus enables the two sets of blade edges, each in its own distinct working plane angled distinctly apart from the other working plane, to be successively presented, from opposite directions, to a smooth stretch of skin to be shaved. In other words, each working plane, in a successive fashion, each at a different time and stroke, engages the skin, with the user changing the direction and the inclination of the razor head at or near the end (or the beginning) of each stroke in what normally is (or should be) a rather fluid and seemingly continuous motion. The in-line construction of the elongated razor head and handle of the shaving devices of the present invention in this third class encourage a user to quite naturally and quickly change the direction and orientation of the razor head to present the other working plane to the skin by simply turning the wrist, thus allowing the user to rapidly shave back and forth. With this (and all other classes of my in-line devices), only one set of razor sharp edges of the blade strips are active, that is in shaving contact with the skin, at any one time. With this third class of in-line shaving devices, the angle of inclination between the working plane is sufficiently great so that even an inexperienced user will understand that the non-cutting blade edges are not in contact with the skin.

Accordingly, this third class of in-line bi-directional shaving devices has benefits over those of the first class. An inexperienced user of an in-line razor shaving device may feel as though the razor-sharp edges pointing in two opposed directions represent a complicated stroking/shaving routine, even though this is not the case. Or such a user may be uncomfortable with the notion of placing two sets of opposed sharpened razor blade edges upon the skin at once. This third class of devices will give that user a feeling of greater control or safety since the non-cutting working plane is clearly off of the skin, which the user may prefer. This in turn may encourage those who might otherwise be timid about shaving with manual razors to begin with to have the confidence to try the in-line bi-directional shaving devices of the present invention, and in so doing, realize this in-line shaving device is both effective and safe.

In a fourth class of in-line bi-directional shaving devices of the present invention, there is provided a single bi-directional head with is formed from two preferably identical elongated uni-directional razor blade cartridges. Examples include the third embodiment shown in the Figures. These cartridges each preferably have straight razor blade strips mounted in their own platform or base, which plugs into or otherwise securely engages a complementary support structure or trough on the common single bi-directional head. The working planes of the two uni-directional cartridges may be co-planar, thus performing in the same manner as the in-line devices in the first class of embodiments of the present invention. Alternatively, the two uni-directional cartridges may be arranged so that their razor-sharp blade edge is (or edges are) each in a distinct working plane, which working planes may be arranged at an angle facing away from one another and intersecting in the range of about five degrees to about 15 degrees or so. When the two uni-directional cartridges are so arranged, the resulting in-line shaving structure performs in the manner described with respect to the second class of in-line bi-directional shaving devices of the present invention. Alternatively, if desired, the uni-directional cartridges may each be arranged so that their working planes are facing away from one another at a still greater angle, such as about 20 degrees or more. When so constructed, the in-line shaving devices of this fourth class perform like the third class of in-line bi-directional devices described above.

In a fifth class of in-line bi-directional shaving devices of the present invention, there are two separate bi-directional head structures arranged end-to-end in a common plane on a single handle. The sixth embodiment shown in FIGS. 21 and 22 illustrates this class of in-line device with its two bi-directional heads arranged in a common plane. This extra-long construction provides a twin bi-directional head to allow large skin areas, such as the chest, stomach or back, to be shaved more rapidly, since two swathes of hair may be cut with each stroke of this in-line shaving device. Each individual bi-directional head structure can be implemented in the manner of those shown in the second, third or fifth embodiments. Accordingly, the shaving techniques associated with the first, second or third class of in-line shaving devices of the present invention may be achieved using suitably made in-line shaving devices in this class.

In a sixth class of in-line shaving devices of the present invention, there are two end-to-end bi-directional shaving heads on a single handle arranged so that the working planes of their faces intersect one another. The seventh embodiment shown in FIGS. 23 and 24 is representative of this class of devices. Like the in-line shaving devices in the fifth class, each head in this sixth class of in-line shaving devices may be implemented like those shown in the second, third or fifth embodiments. Like the fifth class of my in-line shaving devices, this sixth in-line class of shaving devices allows for more rapid shaving. Since the working planes of the respective bi-directional head structures are angled toward one another as shown, this sixth class of in-line shaving devices is particularly well-suited for shaving large-area curved body surfaces, such as the arms, legs or sides of the torso.

Advantages of the In-Line Razors of the Present Invention. The in-line bi-directional razors of the present invention are believed to more readily deliver a closer shave than conventional uni-directional dual-blade wet razors. First, it is easier to shave in two opposite directions with the in-line bi-directional razor of the present invention than with a uni-directional razor on a T-bar handle, since the user's grip on the handgrip portion of the handle of the in-line razor device need not be changed in order to pass the razor across an area of skin to be shaved from two opposite directions. Second, as is well-known, an area of skin is normally shaved closer when a razor is passed across the skin in two opposite directions. Third, in those "single plane" embodiments of the present invention where the razor blades in opposed directions both bear upon the skin simultaneously, the non-cutting blades scrape against the skin, which may well assist in providing a closer shave. In these "one working plane" embodiments of my in-line bi-directional razors, as the forward-moving set of blades cuts hair, the trailing set of blades typically is dragged across the skin. This dragging action may help stretch the skin and thereby facilitate a closer shave by the active blades. Further, the scraping of the skin by the hard sharp edges of the non-cutting blades should loosen dry skin, debris and may also help individual strands or stubbles of hair to stand up further, so they can be cut more closely on the return stroke by those same blades. This scraping action should also have the beneficial effect of helping to spread out more uniformly whatever thin layer of lubricating material remains on or is deposited upon the skin being shaved after the active blades pass over it. The lubricant may be shaving soap lather, shaving cream, or the lubricant from a slowly-dissolving conventional lubricant strip provided on the central rear guard of the razor that is left on the skin.

The in-line bi-directional razor shaving devices of the present invention typically contain twice as many blade edges as does a conventional uni-directional razor. With advances in razor blade metallurgy, manufacture and/or surface protection, blade edges in most present day dual-blade razors corrode more slowly than blades of yesteryear. So, razor blades in daily use tend to dull from use rather than corrosion. By providing twice as many blade edges as are found in a conventional razor head, my in-line bi-directional razor heads may well last almost twice as long, since each blade is essentially doing one-half the cutting of the blades in a uni-directional razor.

Another advantage of my in-line bi-directional shaving devices is that it still can be lifted off of the skin at the end of the stroke in each direction (or at any point in the stroke), if desired. A substantially continuous fluid motion for stroke reversal can still be maintained under such circumstances. For example, the user on the return stroke in the opposite direction can rapidly place the rear longitudinal edge of the active portion of the bi-directional shaving head on the skin and with a very slight natural roll of the wrist can tilt or rotate the razor blade head so that the active blade edges engage the skin on the fly. Thus, a new user of my in-line bi-directional razor (even my single-plane razors), is not forced to immediately use a strictly back-and-forth motion where the razor head is kept on the skin when shaving in order to begin to make use of my in-line razor devices. Instead, the user can initially lift the razor off of the skin, and then with a little practice, can proceed to do so less and less as he or she begins to feel comfortable with the safety of bi-directional shaving technique.

The various constructions of my in-line bi-directional razor blade devices described below are believed to be particularly economical to manufacture. In developing my single-head in-line bi-directional head designs, I recognized that having all of the blades or blade strips arranged relatively near to one another helps reduce the overall width of the head, thus making it easier to handle and less expensive to manufacture and assemble. Further, in my various designs, I often attempted to reduce the number of overall components required, especially the number of pieces that would need to be separately made and/or handled during assembly.

In this regard, in many of the embodiments of the in-line bi-directional razor blade shaving devices of the present invention, the centrally located glide or lubricant strip, located between the two sets of blade strips, does double duty. The glide area or strip is in use no matter which set of blade edges is doing the cutting of hair. Further, the top surface of this common strip (even when curved such as in some of my embodiments) is substantially within and forms part of the structure that defines the working plane (or planes) for the first and second set of blade edges.

Also, I wanted to create structures and components which are easy to make and assemble using automatic equipment in order to achieve very low unit costs per in-line razor head. As a result, the individual components of the bi-directional heads can be made using conventional materials and machinery, and then can be assembled using well-known techniques, to form the completed in-line bi-directional razor head, such as:

(i) stacking plastic parts together so that they can be interlocked and fastened together using press-fit plastic pins, or (ii) assembled and retained together with metal end-piece retaining bands in the manner used by the Gillette Company to form its Sensor® and Mach3™ uni-directional razor cartridges.

For purposes of illustrating the features and advantages of the present invention, the accompanying Figures, in the interest of clarity, at times exaggerate the size, spacing, clearances and/or relative sizes of or between certain parts of the in-line razor head structures and/or their associated handles, necks or yokes. By the studying of the Figures in the drawings and reading the following detailed description and subjoined claims other objects, features, operating principles, and advantages of the in-line bi-directional razors and methods of the present invention will become apparent.

BRIEF DESCRIPTION OF THE DRAWINGS

In the drawings, where the same reference numerals reference like items or features in the different views, there are illustrated seven embodiments of the manual in-line bi-directional razor blade devices of the present invention, all useful for speed-shaving, wherein:

FIG. 1 is a perspective view of this speed-shaving device from its razor head end, with the outer and side guards of the blade-edge guarding system of the head removed from around the two sets of razor blade strips to more clearly reveal the bi-directional razor blade geometry, and showing the in-line handle offset from and connected to one end of the razor head;

FIG. 2 is side perspective view of the FIG. 1 device with the blade edge guarding system in place on the razor head;

FIG. 3 is a top or face view of the FIG. 1 device showing the parallel arrangement and relative spacing of the two sets of outwardly-pointing razor blade strips between the two outer edge (front) guards and the transverse end guards, and showing an elongated central lubricant strip between the two sets of razor blade strips;

FIG. 4 is an enlarged end cross-sectional view of the head structure taken along line 4—4 of FIG. 3 showing the bi-directional blade arrangement and the outer guard members and central lubricant strip arranged in a single working plane, with the two sets of the elongated parallel razor blade strips having their blade edges located in the working plane and pointing outwardly away at an acute angle from the center of the razor head; and FIG. 5 is an enlarged cross-sectional view taken along line 5—5 of the handle in FIG. 3.

FIG. 6 is a side perspective view of the device showing the elongated handle offset from the razor head structure;

FIG. 7 is a top view of the FIG. 6 device showing the two sets of razor blade strips pointing outwardly, away from a centrally-located elongated strip portion serving as the rear guard of both razor blade sets;

FIG. 8 is an enlarged cross-sectional view of the razor head structure taken along line 8—8 of FIG. 7 showing the bi-directional blade arrangement and how the exterior front guard members and rear guard member form two working planes arranged at an angle to and facing away one another; and FIG. 9 is an enlarged cross-sectional view of the device's handle taken along line 9—9 of FIG. 7.

FIG. 10 shows, in transverse cross-section from a view like that of FIG. 8, the razor head structure with the two elongated cartridges in place within the troughs and ready for use; and FIG. 11 shows in a view like FIG. 10, the elongated razor blade cartridges removed from their respective troughs formed in the head structure.

FIG. 12 is a side perspective view of the device showing its generally flat handle arranged in a common plane with the elongated razor head structure, with the cap ready to be slid on the head;

FIG. 13 is a top view of the device showing the face of the head with its bi-directional blade arrangement and blade-guarding system;

FIG. 14 is an enlarged cross-sectional view taken along line 14—14 of FIG. 13 showing the two sets of razor blade strips arranged in a common plane defined by the blade edge guarding system; and FIG. 15 is an enlarged cross-sectional view taken along line 15—15 of FIG. 13 showing the handle shape; and FIG. 16 is an end view of the razor head as in FIG. 14 taken from the direction of arrow 16A in FIG. 13 with the cover installed on the head.

FIG. 17 is a side perspective view showing the bi-directional razor blade head separated from the handle and showing the elongated channel into which one end of the handle can be inserted;

FIG. 18 is a top view of the FIG. 17 device shown in an assembled state, with the handle inserted into the complementary channel generally indicated by hidden lines;

FIG. 19 is an enlarged cross-sectional view taken along line 19—19 of FIG. 18 showing the bi-directional blade arrangement, the two working planes, and a central lubricant strip of the razor head, with the handle in place within the channel of the razor head; and FIG. 20 is an enlarged cross-sectional view taken along line 20—20 of FIG. 18 showing the handle's shape.

FIG. 21 is a side perspective view showing that the two working planes of the first and second bi-directional head portions are co-planar and directly in line with the handle; and FIG. 22 is a top view of the FIG. 21 device more clearly showing the bi-directional blade arrangement of each head structure portion.

FIG. 23 is a side perspective view of the device showing the angle between the two working planes as less than or equal to 170°; and FIG. 24 is a top view of the FIG. 23 device showing the blade arrangements of the individual bi-directional head portions.

DETAILED DESCRIPTION OF THE PREFERRED EMBODIMENTS

Numerous in-line bi-directional razor blade devices and razor head structures therefor are shown in the Figures and discussed herein. While these embodiments are presently preferred, they are still only exemplary of the various possible in-line bi-directional razor blade devices and razor heads of the present invention. As explained further below, I contemplate that, within the scope of the present invention, variants of my in-line bi-directional razor devices may readily be constructed based upon my teachings here.

All of my in-line bi-directional razor blade head structures are preferably symmetrical about a common plane of reference that runs along the longitudinal axis of the device. This includes my single effective head designs formed from two uni-directional razor blade heads, which have an overall longitudinal axis centrally located between the two uni-directional razor blade heads which are preferably arranged with their individual longitudinal axes parallel to one another, and which may be spaced apart from one another. Unless otherwise indicated, my bi-directional head structures are also symmetrical about their central transverse axis. Thus, those in the art should appreciate that, in general, the descriptions herein of one side, end, or section of any given razor head will also serve to describe the other half of the symmetrical structure on the opposite side of the longitudinal axis or central transverse axis.

Figures 1, 2, 3, 4, 5:
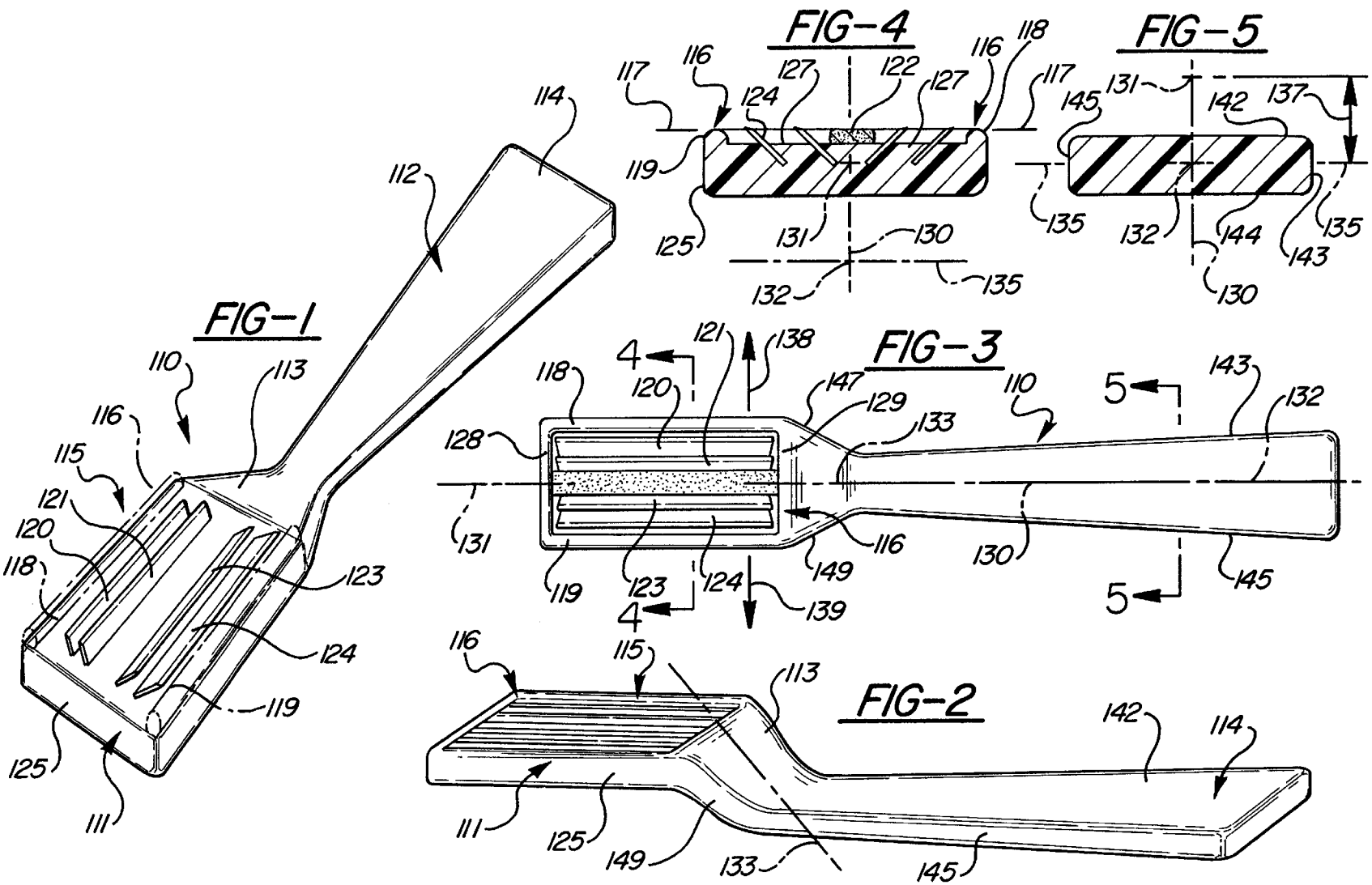
FIGS. 1 through 5 illustrate a first embodiment of an in-line bi-directional razor blade device having a straight elongated handle connected to one end of a flat razor head structure, where.

FIGS. 1 though 5 illustrate a first embodiment of the present invention. This embodiment shows my in-line bi-directional razor blade shaving device in one of its simpler forms, with all of the sharpened edges of its razor blade strips located in a common working plane. FIG. 1 illustrates, in perspective, in-line bi-directional razor device 110, while remaining FIGS. 2 through 5 show various aspects of the FIG. 1 device. Razor 110 is preferably formed of any suitable molded plastic material to provide a head 111 and an integral handle 112. The handle may have an upper end portion or neck 113 which is preferably molded integrally with the head and a lower handgrip portion 114. As shown, handgrip 114, which is generally flat, may increase in width with increasing distance from head 111.

Head 111 has the general shape of an elongated, narrow rectangular strip or bar. It has a substantially flat, exposed shaving face 115, which includes a generally rectangular rim-like blade-edge guarding system 116 partially shown in phantom in FIG. 1, and shown solidly in FIGS. 2 through 4. Blade guarding system 116 includes required longitudinally-arranged first and second front guard portions 118 and 119, shown in phantom in FIG. 1, and shown solidly in FIG. 4, and optional transversely-arranged end guard portions 128 and 129, as best seen in FIGS. 3 and 4. These guard portions preferably each have relatively flat elongated face surfaces, as generally shown, with rounded edges and outside corners to prevent inadvertent scratching of the skin to be shaved. Guard system 116 also includes an optional elongated central rear guard portion 122, shown in FIG. 3. Rear guard 122 may have a smooth plastic surface, or may be provided with a conventional lubricant strip bonded thereto. The flat face surfaces of front guard portions 118 and 119 and rear guard portion 122 are arranged in and together define a common working plane 117. Plane 117 generally is coextensive with that portion of face 115 which is placed in contact with a user's skin. Plane 117 is also the plane into which the razor-sharp edges of the razor blade strips project and extend. The skin of the user is very substantially protected from undesired cuts and nicks from the razor-sharp blade edges by this blade-edge guarding system 116. As shown in FIGS. 3 and 4, central strip 122 functions as a rear guard for both pairs of razor blades.

As seen in FIG. 1, head 111 is provided with a first set of straight elongated razor blades 120 and 121, and a generally opposite second set of straight elongated razor blades 123 and 124. These blades are each formed of a narrow, very thin, single, straight, razor blade strip having a razor-sharp outer edge. Typically, the strip will be flat and have a thickness of about 0.005 inch (0.13 mm) or less. The overall width of each blade strip is preferably in the range from about ⅛ inch (3.2 mm) to about ¼ inch (6.5 mm). As best shown in FIG. 4, each blade strip has an inner portion, for example, portion 126 of strip 120, which is embedded within lower platform section 125 of head 111, and an outer portion with a razor-sharp edge, for example razor-sharp portion 127 of strip 120, which extends outwardly from head 111 for cutting hair (or hair stubble) by shaving it at the skin line. The blade edges in each set are preferably parallel to one another and to the blade edges in the other set of blade strips. The sets of sharpened blade edges are arranged at acute opposite angles to working plane 117, so that the razor-sharp edges of the first set of blade strips 120 and 121 cut in when head 111 is moved in a first direction, while razor-sharp blade edges of the second set of razor strips 123 and 124 cut when head 111 is moved in a second opposite direction. Thus, while one pair of blade edges is cutting, the other pair is merely dragging behind, riding along upon the skin. If rear guard 122 is omitted, as it may be if desired, these dragging non-cutting blade edges will also serve as part of the rear guard, in that they will help establish the working plane for the set of blade edges which are doing the cutting. The front guard of the set of non-cutting blade strips being dragged along will also serve as part of the rear guard to establish the working plane for the set of blade edges which are doing the cutting.

In terms of overall dimensions, face 115, by way of example, may be about ⅜ inch (9.5 mm) to about ½ inch (12.7 mm) or larger in width and about 1–1½ inch (38 mm) in nominal length. Head 111 may be about 3/16 inch (4.8 mm)

to about ¼ inch (6.4 mm) or more in thickness. In practice, these dimensions for head 111 may vary considerably. For example, the length may be about 1 inch (2.5 cm) to about 2.75 inches (7 cm) or longer, but in general it can be seen that the head has a narrow, generally rectangular elongated shape. The handle 112, including neck portion 113, may be between just under about 3 inches long (about 7 cm) to just over about 6 inches long (about 15 cm) or longer. In order to allow head 111 to be made using conventional razor blade strips having a length on the order of 1.3 inches (32 mm) to about 1.5 inches long (about 38 mm), the overall length for the head, including end guard portions, is preferably about 1.5 inches (about 38 mm) to about 1.7 inches (about 44 mm).

As shown in the drawings, the pairs of blade strips 120, 121 and 123, 124 are closely adjacent to each other, for example, on the order of about 1/32 inch (0.8 mm) to about 1/16 inch (1.6 mm). Central rear guard/lubricant strip 122 may have any suitable width, for example, about 3/32 inch (2.4 mm) to about 3/16 inch (about 5 mm). Strip 122 preferably has a length substantially coextensive with the length of the razor blade strips, as shown in FIG. 3. Strip 122 may extend substantially fully between end portions 128 and 129. The width of rear guard 122 and spacings between the razor blade strips may be varied as desired. Also, guard 122, along with the other guard portions 118, 119, 128 and 129, may be integrally formed in plastic (not shown) with the lower portion 125 of razor head 111. Thus, for example, rear guard 122 may be formed as an elongated integral mesa projecting above flat inner surface 127 of razor head 111. If desired, a thin lubricant strip may be bonded or otherwise attached to the top of this mesa. Inner surface 127 of platform 125 is preferably rimmed on all four sides by the blade-edge guarding system 116. The elongated front guards 118 and 119 preferably have exposed face surfaces that each essentially describe an elongated straight broad line residing in the working plane 117. If desired, transverse end guards 128 and 129 may have face surfaces which are slightly raised so as to extend slightly above working plane 117, especially near rear guard 122, since skin is generally pliable.

Rear guard 122 can also be elevated somewhat, if desired. In such an instance, the exposed face surfaces of front guard 118 and rear guard 122 would specifically define the first working plane into which razor-sharp edges of blade strips 120 and 121 extend. Similarly, the exposed face surfaces of front guard 119 and rear guard 122 would specifically define the second working plane into which razor-sharp edges of blade strips 123 and 124 extend. In this example, there can be an angle of a few tenths of a degree up to about 5 or even about 10 degrees between the two working planes, as illustrated in some of the further embodiments.

Preferably, each of the blades 120, 121, 123 and 124 is formed of conventional flat stock razor blade material, such as a stainless steel alloy. Alternatively, the blade material may be sintered metal, such as a hard carbide, or any other suitable razor blade alloy material. The blades may also be provided with a micro layer of any conventional or suitable anti-corrosion material. The blade strips are preferably pre-sharpened, cut to length, and then installed in base portion 125 of head 111 during construction of razor 110. The blade strips may be embedded in the head of the razor during the molding of the razor head. Alternatively, they may be inserted in slots or sockets provided in a molded head or a head made from assembled pieces for the purpose of receiving the blades. The blades may be fastened in their sockets by the molding of plastic around them, or adhesively, or by any conventional or suitable mechanical fastening means, including cold-headed plastic pins, as illustrated in later embodiments of the present invention. Blade strips 120, 121, 123, 124 are each preferably continuous, of uniform width, and extend along almost the entire length of head 111. Opposed end portions of the blade strips may be positioned under the opposed end guards 128 and 129 (not shown), which end guards may be hollow or made or rimmed in conventional metal bands for this purpose, if desired.

The two opposing pairs of blades extend outwardly at equal and opposite acute angles relative to face 115 and working plane 117 of the head of razor 110. This acute angle may be any suitable value, such as in the range of about five degrees to about 40 degrees, with angles in the range of 15 to 35 degrees being presently preferred.

Several further observations may be made regarding the overall geometry of shaving device 110. Device 110 has a central longitudinal plane 130 (as best seen in FIGS. 3, 4 and 5) in which central longitudinal axis 131 of head 111 and central longitudinal axis 132 of handle 112 both lie. Plane 130 is sometimes referred to herein as the plane of reference or the plane of symmetry, since in virtually all embodiments of the present invention, the one half of the shaving device on one side of this plane is a mirror image of the other half of the shaving device on the other side of this plane. As can be best seen in FIGS. 4 and 5, axes 131 and 132 are not coincident, even though they lie in the same plane 130, as can be seen when razor 110 is examined from a plan view (e.g., from the top) as in FIG. 3. Head 111 and handle 112 are preferably arranged so that their axes 131 and 132 are parallel. (However, head 111 and handle 112 may be slightly angled relative to another, so that axis 132 intersects axis 131 at some point, if desired, preferably near the center of head 111.

FIGS. 4 and 5 show central plane 130 as a line, with the parallel axes 131 and 132 (which extend into and out of the paper) appearing as dots on line 130, to show their relative spacing. Neck 113 also has a central axis 133, which also lies in plane 130, and is shown arranged at an angle of about 45 degrees relative to axes 131 and 132. (But, as will be seen in later embodiments, this neck angle may be anywhere from zero degrees to about 90 degrees, as desired.) Neck 113 is preferably of a moderate length, on the order of about ¼ inch (about 6 mm) to roughly /4 inch (about 20 mm). When axis 133 is arranged at a suitable angle, neck 113 provides an offset between the working plane 117 from the central transverse plane 135 of handle 112, as shown in FIGS. 2 and 4. Preferably this offset distance, as indicated by vertical dimension 137 in FIG. 5, which also shows the location of transverse plane 135. Dimension 137 is preferably on the order of about 0.5 inch (about 12 mm) to about one inch (about 25 mm). This offset may be made smaller or larger if desired. In general, having the handle or rearwardly offset from the shaving head, as shown, allows the fingers of the user to avoid rubbing against a skin surface. This is generally desirable, and maybe important when shaving certain large body areas. For example, if someone were shaving a hairy stomach, and had lathered the entire stomach area with shaving cream, this lateral offset would help the user's fingers stay above the shaving cream, rather than wiping through it. Thus, the lateral offset is preferably ⅝ inch (about 16 mm) or greater.

The manner in which in-line bi-directional shaving device 110 is used has already been described in the Summary of the Invention with regard to the first class of shaving devices of the present invention. Thus, it will only be briefly reviewed here. While gripping handle 112, a user places razor head 111 against the skin to be shaved and moves head 111 back-and-forth in the directions of arrows 138 and 139 shown in FIGS. 3. These arrows define first and second opposite directions generally perpendicular to axes 131 and 132. Note that these razor blades may be moved in directions that are at an angle (anywhere from 0° to 45° or more) to axes 131 and 132, and still cut hair. But it is preferred to make the back-and-forth motions of razor head 111 substantially perpendicular to axes 131 and 132, for optimum performance. This helps ensure that the same regions of the skin are shaved from two opposite directions. With reference to FIG. 3, when razor 110 and its head 111 are moved upwardly along the skin, as indicated by arrow 138, the razor-sharp edges of the first set of razor blade strips 120 and 121 cut hair, while the edges of the second set of razor blade strips 123 and 124 drag along the skin, without cutting. Then, when razor 110 and its head 111 are moved downwardly along the skin, as indicated by arrow 139, the razor-sharp edges of the second set of razor blade strips 123 and 124 cut hair, while the edges of first set of razor blade strips 120 and 121 drag along the skin, without cutting.

As can best be seen in FIG. 4, the first set of blade strips 120, 121 have their razor-sharp edges positioned in a first working plane defined principally by elongated front and rear guard portions 118 and 122. Note that, too a much lesser degree, end portions 128 and 129 may also be used to help define this working plane, particularly if their face surfaces are substantially level with the working plane. The second set of blade strips 123 and 124 have their razor-sharp edges positioned in a working plane defined principally by elongated front and rear guard 119 and 122. Again, end portions 128 and 129, too a much lesser extent, may also help define this second working plane. As shown in FIG. 4, these working planes in shaving device 110 are shown coincident with common plane 117. Razor 110 may be used in almost any direction when shaving legs, arms, stomachs or any other large areas of the body to be shaved. Razor 110 may even be used to shave the face of another or the user's own face, if desired.

I prefer to have the in-line bi-directional razor blade shaving devices of the present invention, including razor device 110, used on the arms and legs by having the shaving strokes in the first and second directions run along generally parallel to the major axis of the limb being shaved. In other words, a user shaving her arm may first stroke downwardly, in the direction from the elbow toward the wrist, and then upwardly, in the opposite direction from the wrist to the elbow. Similarly, a person shaving a leg may stroke first downwardly in the direction from the knee to the ankle, and then upwardly in the direction from the ankle to the knee. When shaving other areas of the body, such as the stomach or face, I prefer to have most of the strokes made along the lines of least curvature on the skin surface, i.e., the lines that curve the least, rather than the most. For example, on the stomachs of a fit and trim person, this generally would be an upward and downward motion, rather than one generally parallel to the waist line. Preferably, head 111 of razor device 110 is provided with a removable cover or cap (not shown) that may be like the cover shown in FIGS. 12, 13 and 16.

The handgrip portion 114 of handle 112 has upper and lower flat face surfaces 142 and 144, and flat opposed side surfaces 143 and 145. Face surfaces 142 and 144 are preferably parallel to one another and to plane 135. Handgrip portion 114 is shown gently tapering from a broad distal end to a smaller neck area, so that the distance between sidewalls 143 and 145 decreases continuously as the distance to neck portion 113 decreases. At the narrowest width of handle 112, sidewalls 143 and 145 of handgrip 114 connect to sidewalls 147 and 149 of neck 113, which flares outwardly to meet the outer sidewalls of the base portion 125 of razor head 111. Alternatively, handle 112 may be shaped in a configuration which is more curved or straighter than shown, as desired.

Figures 6, 7, 8, 9, 10, 11:
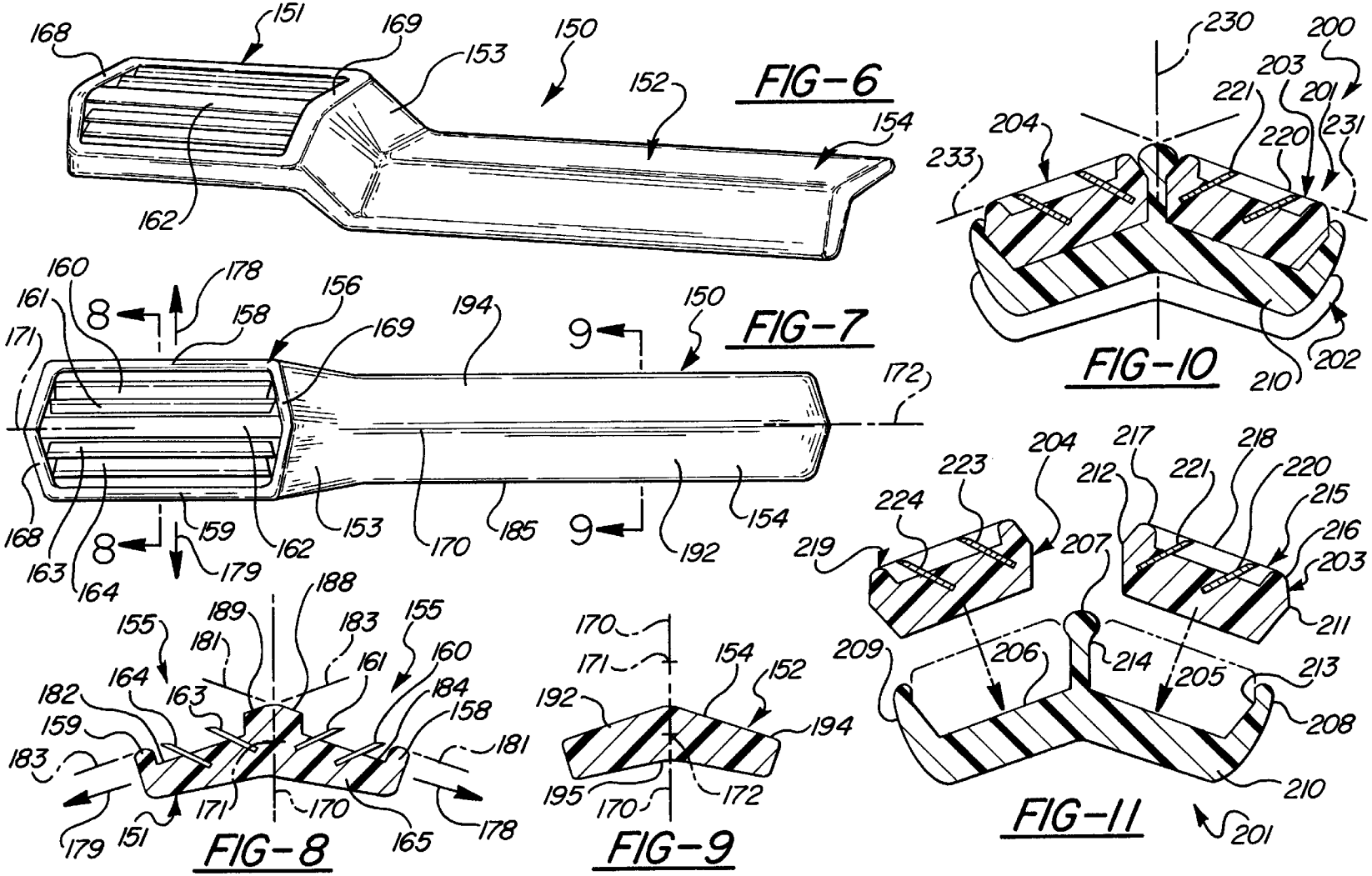
FIGS. 6 through 9 illustrate a second embodiment of an in-line bi-directional razor blade device having a straight elongated handle connected in-line through an angled neck portion to one end of a bi-directional razor blade structure that has two working planes at an angle to one another, where.
FIGS. 10 through 11 illustrate a third embodiment of an in-line bi-directional razor blade device similar in all respects to the FIG. 6 device except for having a wider handle and a thicker and wider razor head structure, in which is provided two elongated troughs generally parallel to the longitudinal axis of the handle for frictionally receiving two elongated razor blade cartridge structures therein, where.

FIGS. 6 through 9 illustrate a second embodiment of the present invention, namely in-line bi-directional shaving device 150, which includes elongated head 151 arranged in-line with elongated handle 152. Handle 152 includes offset neck portion 153 and handgrip portion 154. Face 155 of razor head 151 has a shallow upside down V-shape when viewed in transverse cross-section, as best seen in FIG. 8. The transverse cross-section of handgrip 154 has a similar inverted V-shape, as shown in FIG. 9, as does the cross-section of neck portion 153.

FIG. 7 shows that razor head 151 includes a rim-like blade-edge guarding system 156, including required elongated first and second front guard portions 158 and 159, which are preferably flat and smooth. System 156 may optionally include transversely-arranged end guard portions 168 and 169, which, as shown, may be bowed slightly outwardly, if desired. Like guarding system 116 in the FIG. 1 embodiment, guarding system 156 preferably has rounded edges and outer corners to help protect the skin of the user from undesired cuts and nicks by the razor-sharp blade edges. As shown in FIG. 6, end guards 168 and 169 also have an inverted V-shape in transverse cross-section, with relatively flat opposed elongated half face surfaces, facing slightly away from one another, as generally shown. Guarding system 156 also includes a required elongated centrally-located rear guard portion 162, shown in FIGS. 6–8. The exposed face surface of rear guard 162 may be smooth plastic as shown, or it may be provided with a lubricant strip (not shown). As shown in FIG. 8, the face of rear guard 162 is divided into two elongated smooth generally flat half-faces 188 and 189. The generally flat elongated face surface of first front guard 158 and first flat half-face 188 of rear guard 162 form and define a first working plane 181. Similarly, the elongated flat face surface of second front guard 159 and second flat half-face 189 of second rear guard 162 form and define a second working plane 183. The angle of separation between the first and second working planes is significant, and is shown in FIG. 8 as about 40°. This angle may be in the range of about 15° to about 100°, is preferably in the range of 20° to 80°, and most preferably is in the range of about 30° to about 60°.

As seen in FIGS. 6 through 8, head 151 is provided with a first set of elongated straight razor blades 160 and 161, and a generally opposed second set of elongated straight razor blades 163 and 164. These blades may be made and installed like the razor blade strips in the FIG. 1 embodiment. Each blade strip has an inner portion embedded in inner surface 182 or 184 of the lower platform section 165 of head 151, and an outer portion with a razor-sharp edge which extends outwardly from head 151 for cutting hair or hair stubble by shaving it at the skin line. The blade edges in each set of blade strips are preferably parallel to one another and to the blade edges in the other set of blade strips. The blade edges of blade strips 160 and 161 cut hair when the first working plane 181 is placed on the skin and razor head 151 is moved tangentially along the skin in the direction indicated by arrow 178. Similarly, the razor-sharp edges of blade strips 163 and 164 cut hair when the second working plane 183 of razor head 151 is placed on the skin and is moved in a second direction 179 generally opposite to first direction 178. The blade edges are preferably parallel to the plane of symmetry 170 of device 150, which is discussed next.

As shown in FIGS. 7 through 9, razor blade device 150 is symmetrically arranged about central longitudinal plane 170, in which the central longitudinal axes 171 and 172 of head 151 and handgrip 154 both lie. Also, as in all of my embodiments, and as shown, blade edges of the two opposed sets of blades are equidistant from symmetry plane 170. Specifically, the razor-sharp edges of front blades 160 and 164 are equidistant from plane 170, and the razor-sharp edges of rear blades 161 and 163 are also equidistant from plane 170. In all of my embodiments, the front blade edges are spaced slightly farther from plane 170 than are the rear blade edges.

Central longitudinal axes 171 and 172 of head 151 and handle 152 are preferably parallel to one another, as shown, and in virtually all other embodiments herein. This is a preferred arrangement, since a user quickly learns how to judge the precise tilt or lie of the bi-directional razor blade head against his or her skin by mentally noting the angle of inclination of the handle relative to the area of skin being shaved.

However, in all my embodiments, the longitudinal axis of the handle may be inclined relative to the longitudinal axis of the head, if desired, as long as both axes remain in the plane of symmetry. By way of example with respect to FIGS. 6–9, axis 172 may be inclined relative to axis 171, as desired, as long as both axes remain in the symmetry plane 170. Specifically, axis 172 may be oriented so as to tilt handle 152 toward the exposed razor blade strips by an angle from 5° to about 30°, or away from the exposed razor blade strips by an angle of about 5° to about 50° if desired. Preferably, such an angle of handle inclination away from the exposed blade strips would be between about 10° and about 40°, with an angle between about 15° and about 30° being most preferred, if the handle is to be tilted at all. In this later inclined handle situation, it is also preferred that the axis 172 of the handle intersect axis 171 of the head near the center of head 151. In such a case, neck portion 153 may still be used to provide a transition between the head and handle, or it may be eliminated, as desired. Also, the neck portion even may be attached to the rear of base portion 165 of razor head 151, including at any desired location, near the geometric center of head 151, rather than at one end thereof, as shown in FIGS. 6 and 7. Those skilled in the art should appreciate that these same kinds of inclined handle variations can be used with most other embodiments of the present invention, if desired.

In FIG. 7, side surfaces 184 and 185 of handgrip portion 154 are generally shown tilted a slight angle, although the corresponding opposed edges of surfaces are arranged parallel to one another. As can be seen in FIG. 8, the side surfaces of base portion 165 of razor head 151 are also arranged at the same tilted angle, in order to provide the same stylish common design appearance on both razor head 151 and handgrip 154.

An advantage of the inverted V-shaped cross-section of handle 152 is that it provides a shallow depression 195 on the back surface of handgrip 154, into which a user may place his or her thumb when grasping the handgrip for shaving. Also, front face surface of handgrip 154 has two distinct elongated flat half-face surfaces 192 and 194 arranged at an angle to one another, which preferably mimics (i.e., is substantially equal to) the separation angle between the working planes 181 and 183. These two angled half-faces 192 and 194 advantageously substantially conform to the natural curvature of a user's fingers opposite an opposed thumb that is positioned on the other side of handgrip 154, which occurs as the user wraps his or her fingers and thumb around handgrip 154 when using device 150 to shave.

FIGS. 10 and 11 show a third embodiment of the present invention, in assembled and exploded cross-sectional views, namely in-line bi-directional shaving device 200. Device 200 includes an elongated twin-cartridge razor head 201 arranged in-line with handle 202. Handle 202 is constructed like handle 152 in the previous embodiment, except that handle 202 is wider, as wide as cartridge head 201, as can be seen in FIG. 10. Like all other embodiments of my present invention, device 200 is symmetrically arranged about longitudinal plane of symmetry, which is shown as a vertical line 230 in FIG. 10. Length of razor head 201 is preferably 1.5 times to three times or more as long as the transverse width of head 201.

Razor head 201 carries two elongated uni-directional cartridges 203 and 204 whose working faces and working planes are angled away from the plane of symmetry 230 and from each other as shown. This results from cartridges 203 and 204 being installed into elongated troughs 205 and 206, which are each tipped away from plane 230 at an angle precisely equal to one-half of the separation angle between the working planes. Troughs 205 and 206 are formed by longitudinally-arranged elongated central wall portion 207, longitudinally-arranged elongated sidewall portions 208 and 209, and flat interior bottom surfaces and transversely arranged end walls (not shown) of base portion 210 of head 201.

As shown in FIGS. 10 and 11, the outwardly-facing side surfaces of cartridges 203 and 204 are complementary to the inwardly-facing, side surfaces of troughs 205 and 206. For example, cartridge 203 includes two outwardly-bowed, sloped sidewalls with elongated apex edges 211 and 212, which edges fit into corresponding elongated recesses 213 and 214 in the sidewalls of trough 205. The top bulbous portion of central wall 207 curves out partially into the trough area, as do the inwardly-inclined top portions of sidewalls 208 and 209. Walls 207, 208 and 209 are preferably made sufficiently thin so as to be somewhat bendable or compliant, to allow the cartridges to be snappingly engaged into the troughs. Thus, the sidewall features of the cartridges mechanically engage complementary features of the troughs, thus holding the cartridge in place in the trough, until a user deliberately snaps the cartridge out of the trough. This of course may be done when a user wishes to replace a cartridge having spent or dull razor blade strips with fresh razor-sharp edges. In all embodiments having twin uni-directional cartridges, replacement of both cartridges at the same time is recommended. The end walls (not shown) of the cartridges 203 and 204 each preferably have a gripping surface, or a raised transverse rib. Such a mechanical feature allows a user to pinch the cartridge from the opposed ends so as to be able to safely extract it from its trough by pulling upwardly, away from the trough, from one or both ends of the cartridge. Preferably, the transversely-arranged end walls (not shown) of the troughs are at least partially cut away to allow a user's fingers to get a suitable grip upon each cartridge.

Cartridges 203 and 204 are preferably identical in construction. They appear different in FIGS. 10 and 11, because one is generally rotated 180° from the orientation of the other. In this manner, they together provide two sets of opposed razor blade strips, with each set pointing in generally opposite directions. Each cartridge contains a pair of razor blades arranged at the same acute angle to its working plane, as defined by its blade edge guarding system. For example, cartridge 203 includes blade-edge guarding system 215 formed from elongated front and rear guard portions 216 and 217 and transversely-located end guard portions, such as end guard portion 218. Similarly, cartridge 204 has a blade-edge guarding system 219 formed from elongated front and rear guards and optional end guards, just like cartridge 203. The top exposed surfaces of blade edge guarding system 215 of cartridge 203 form working plane 231, into which the razor-sharp edges of blade strips 220 and 221 project, while the top exposed surfaces of blade edge guarding system 219 form working plane 233 into which the razor-sharp edges of blade strips 223 and 224 project.

As best shown in FIG. 10, the two sides of the upper exposed surface of central wall 207 immediately adjacent symmetry plane 230 are preferably arranged to be generally in-line with, and form a lateral extension of the rear guard surfaces for working planes 231 and 233. This forms a larger effective area of flat contact for the rear guards of cartridges 203 and 204. This larger flat area for each rear guard should help improve the ease with which a user of shaving device 200 is able to place each working plane of razor head 201 upon the skin to be shaved as the razor head it is repetitively stroked back and forth in two opposite directions.

Figure 16:
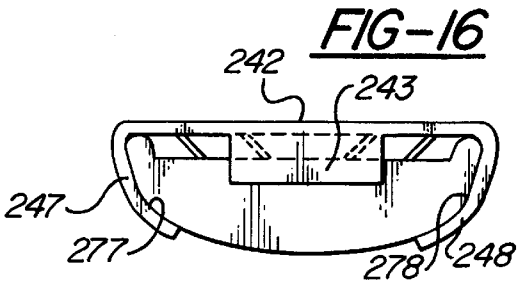
Figure 15:
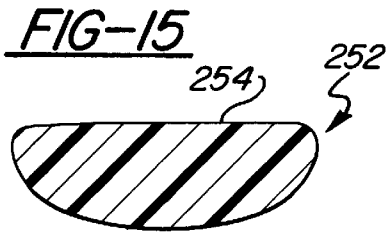
Figure 14:
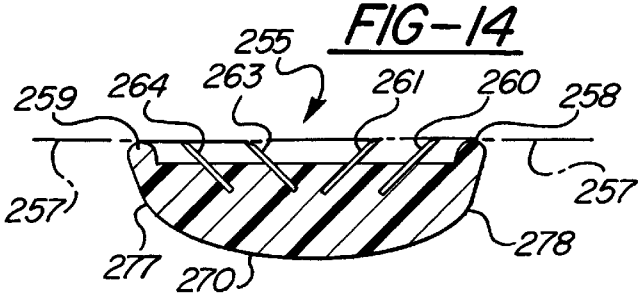

FIGS. 12 through 16 show a fourth embodiment of the present invention, namely in-line bi-directional shaving device 250 with elongated razor head 251 arranged in-line with an elongated handle 252. Razor head 251 has two sets of opposed outwardly-pointing razor blade strips. Notably, no central rear guard is provided in this embodiment. This permits the two sets of opposed blade strips to be positioned closer together, to provide a four-bladed bi-directional head with a narrower width. A protective cover or cap 240 is provided, which can be inserted over head 251, when device 250 is not in use, as shown in FIG. 16, to protect the user from inadvertently contacting the razor-sharp edges.

Figure 12:
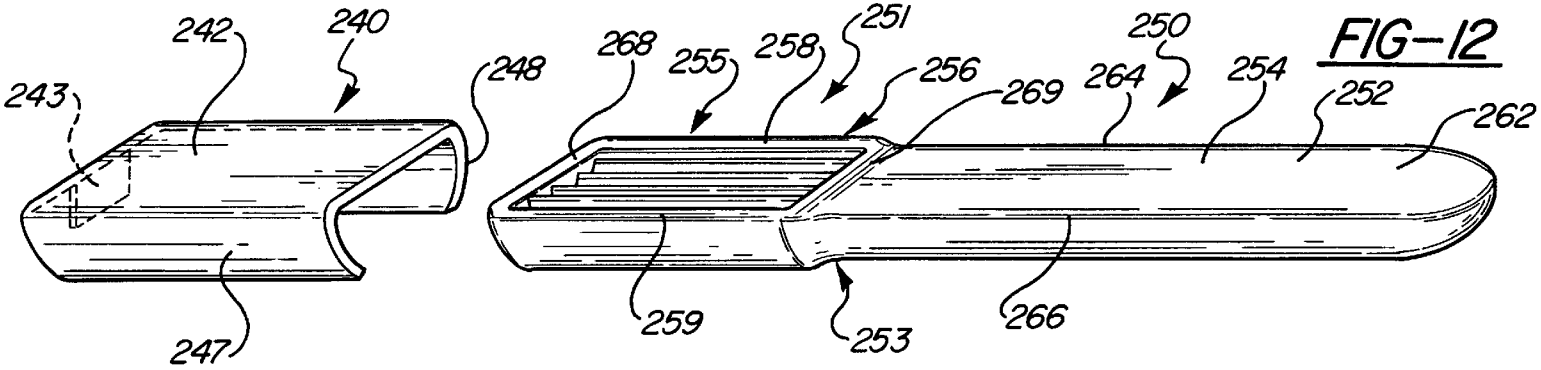
FIGS. 12 through 16 illustrate a fourth embodiment of an in-line bi-directional razor blade device having a straight elongated handle connected directly in-line to one end of a flat razor head structure which does not have a central lubricant strip or centrally-located rear guard, but which includes a blade-covering cap member, where.
Figure 13:
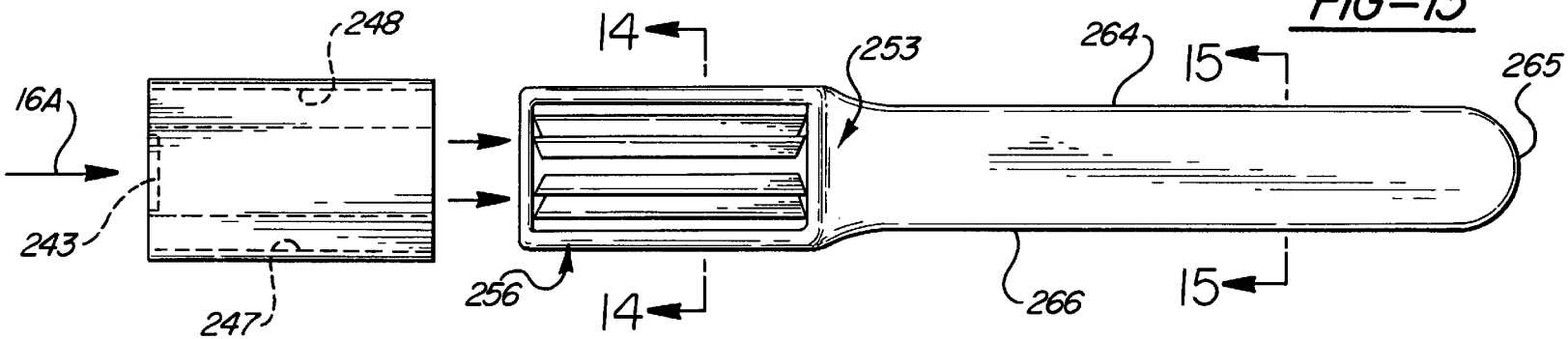

In FIG. 12, face 255 of razor head 251 is shown to be defined in part by rim-like rectilinear blade-edge guarding system 256 having two elongated front guard portions 258 and 259 with optional transversely-located end guard portions 268 and 269. The upper exposed surfaces of system 256 define a working plane 257 into which the razor-sharp edges of the two opposed sets of razor blade strips 260, 261 and 263, 264 project.

Face 255 is shown substantially flush with the planar face surface 262 of handgrip portion 254. Upper elongated side edges 264 and 266 of handle 252 are shown parallel to and spaced from one another, and interconnected by rounded distal end portion 265. The width of handgrip 254 is slightly less than the width of head 251, and thus neck portion 253 expands gently outwardly as the distance to head 251 decreases, to provide a gently curved transition between head 251 and handgrip 254.

Cap 240 includes a generally flat top wall 242, and a centrally-located end wall 243 and inwardly-curving sidewalls 247 and 248 which all depend downwardly from top wall 242. Elongated interior corner edges 248 and 249 formed respectively at the intersection of top wall 242 and sidewalls 246 and 247 are spaced and sized to slide over and almost snugly engage corresponding external surfaces of head 251. Cover 240 may take any suitable shape which has an interior hollow volume that conforms to the razor head's overall configuration. In other words, for the FIG. 1 embodiment, the cap may have a generally hollow rectangular transverse cross-section, with an open bottom and substantially closed top. For razor heads having a generally semicircular cross-section, like somewhat flattened semicircular transverse cross-section 270 of head 251 of shown in FIG. 12 and 14, with its inwardly curved side surfaces 277 and 278, a cover having corresponding, slightly larger side walls 247 and 248, is appropriate. Such covers may be made of any conventional or suitable material, including transparent or translucent plastic, such as suitable density polystyrene or polyethylene. Such a cover may be formed of a molded plastic in a trough-like shape, to fit snugly over the sidewalls of razor head, so as to cover up the razor-sharp edges of the blade strips when the head is not in use. The cover is preferably dimensioned so that it may be manually pushed over the head and will remain in place due to friction and the bending forces generated by placing the cover over the head, which bias the sidewalls of the cover to remain depressed against the head until the cover is manually pulled off.

While a cover is not shown with each of the embodiments herein, those skilled in the field should appreciate that a cover like cap 240 can be and preferably is provided with each embodiment. For those embodiments with a razor head having a transverse cross-section that has V-shape, the top surface of the cover should be provided with a complementary V-shaped cross-section. For those embodiments having twin uni-directional razor blade heads, one large cover, or two smaller covers, one for each uni-directional cartridge, may be provided. Round or elongated holes (not shown) may also be provided in the top flat surface of the cover so as to provide for ventilation. In this manner, moisture remaining on a covered razor head, perhaps from the head being rinsed off after shaving, will eventually evaporate. Such holes are preferably sufficiently small in size and/or transversely or diagonally arranged so that a user's thumb or finger will not come in contact with the razor-sharp blade edges, even when pressing on the cover directly over the blade strips.

FIGS. 17 through 20 show a fifth embodiment of the present invention, namely in-line shaving device 300, which has an elongated cartridge-style bi-directional head 301 arranged in line with and detachable from handle 302. Handle 302 includes a proximal insertion portion or neck portion 303 and elongated hand grip portion 304. As shown, the entire length of handle 302 may have an identical transverse cross-sectional shape if desired. Preferably, the cross-sectional shape of at least the neck 303 can be any practical shape which can be interlockingly received within a correspondingly-shaped cavity 305 in the rear surface 325 of head 301. This cross-sectional neck and handle shape may be a pentagon, for example, as is shown at distal end surface 306 in FIGS. 17 and 20. Specifically, pentagonal handle 302 has elongated twin upper half surfaces 307 and 308, generally opposed side surfaces 309 and 310, and bottom surface 311.

Figure 17:
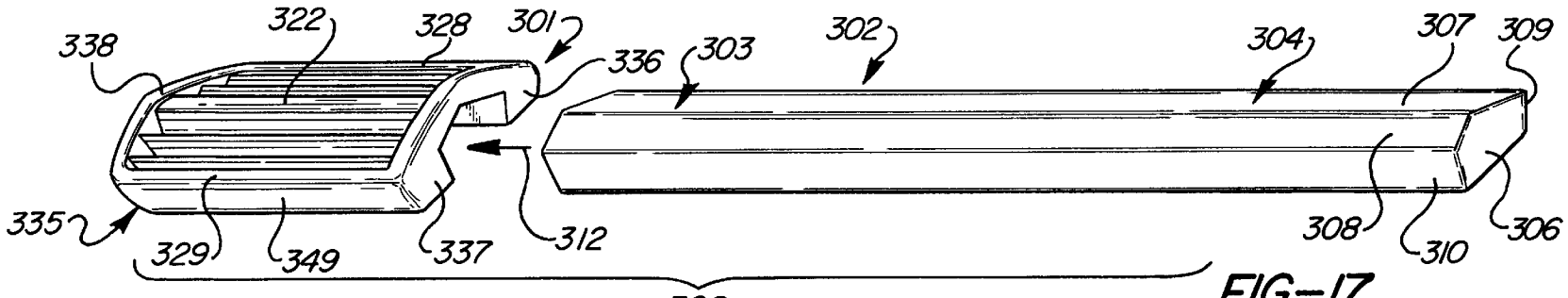
FIGS. 17 through 20 illustrate a fifth embodiment of an in-line bi-directional razor blade device having a replaceable head structure (i.e., cartridge) with two working planes, which head separates from its elongated handle, where.
Figure 18:
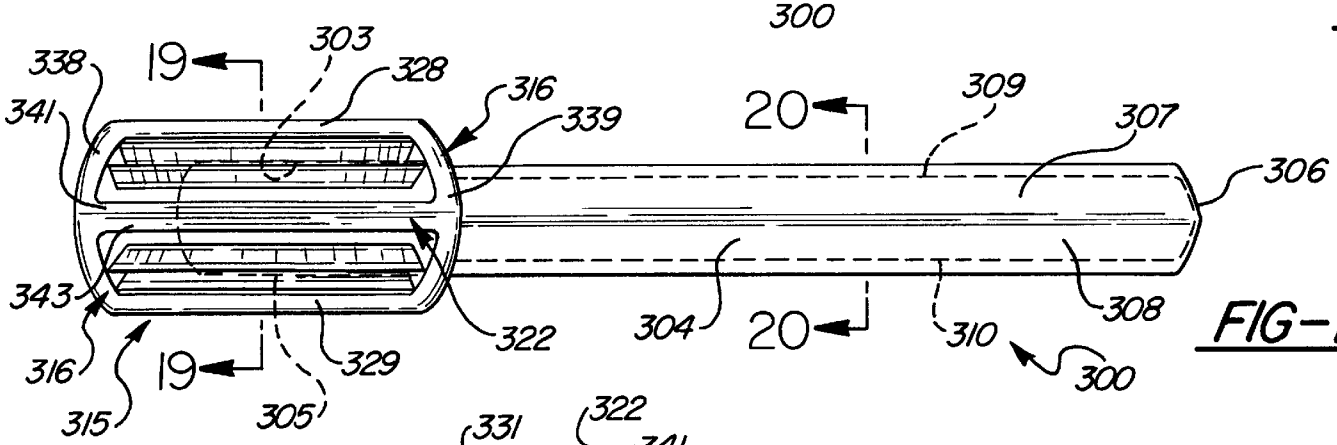
Figure 20:
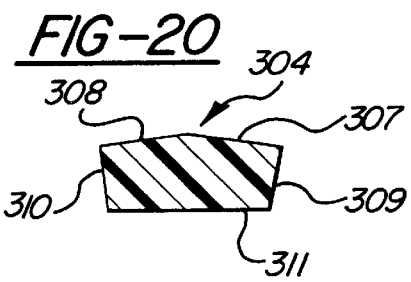
Figure 19:
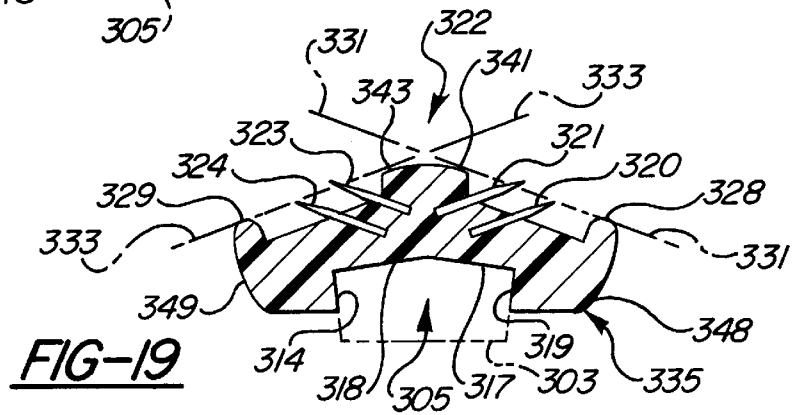

Proximal end 303 of handle 302 is inserted, as indicated by arrow 312 in FIG. 17, into elongated centrally-aligned open cavity 305 in the rear surface 325 of base portion 335 of head 301. Proximal end 303 is preferably inserted at least about two-thirds of the way along the length of head 301, as shown in FIG. 18. As shown in FIG. 19 and 20, elongated cavity 305 includes four interior surfaces, including upper surfaces 317, 318 and opposed side surfaces 319, 314. These interior surfaces are complementary to and snugly engage against upper surfaces 307, 308 and side surfaces 309, 310 of handle 302. Generally speaking, a rear connection mechanism for attaching removable bi-directional cartridge 301 to handle 302 is preferred, since it does not interfere with the appearance or utility of the working side or front face 315 of the bi-directional cartridge 301.

While one possible connection mechanism for interconnecting head 301 and the handle been shown, variations are clearly possible. For example, any suitably handle shape which can be removably locked into a complementary connection portion formed in the rear side of base portion 335 can be used, including handles having circular, oval or triangular transverse cross sections, provided that a trough, hole or slot of complementary shape is provided in base portion 335. Those in the art should appreciate that this male-female connection arrangement can be reversed, with the male connection mechanism been provided on the base portion 335 of razor head 301, and the female connection portion being provided in the proximal end 303 of handle 302. Further, any other detachable mechanical interconnection between head 301 and handle 302 may be used for removably, yet rigidly, interconnecting an elongated handle to a razor head may be used, including conventional mechanical slide mechanism and/or a shaft and socket mechanism with a spring-loaded ball-detent. These comments with regard to detachable connection mechanisms for removably attaching the bi-directional razor head to the handle maybe applied to all of my embodiments of the present invention. In other words, even though a handle and razor head are shown internally formed, those skilled in the art should appreciate that, if desired, the handle and razor head can be made detachable. Similarly, the uni-directional heads or cartridges shown herein in any of the embodiments may be made detachable in several different ways, using different connection mechanisms, if desired.

As shown in FIG. 19, bi-directional razor head 301 preferably has a blade-edge guarding system 316 including first and second elongated front guards 328 and 329, centrally located elongated rear guard 322, and optional transversely-arranged end guard portions 338 and 339, as best seen in FIGS. 17 and 18. These guard portions preferably each have relatively flat elongated face surfaces, as generally shown, with rounded edges and outside corners. Opposed sets of razor blade strips 320, 321 and 323, 324 are respectively positioned between first and second elongated front guards 328 and 329 on either side of rear guard 322. Guard 322 may be provided with a thin lubricant strip P on its surface, as shown in FIGS. 18 and 19. As with razor head 151 in the second embodiment, head 301 has two working planes 331 and 333 which are angled away from one another. In the FIG. 19, the angle of inclination between the two planes shown to be about 40 degrees, but may be any suitable value, as was previously discussed with respect to the second embodiment.

Working plane 331, into which razor sharp edges of blades 320 and 321 project, is defined by front edge guard 328 and a rear guard formed from exposed elongated half-surface 341 of central guard 322. Similarly, working plane 333, into which razor-sharp edges of blades 323 and 324 project, is defined by front edge guard 329 and a rear guard formed from exposed elongated half-surface 343 of central guard 322. It is noteworthy that the razor-sharp edges of rear blades 321 and 323 are shown to project a little bit further through the working plane, more so than the razor-sharp edges of forward razor blade strips 320 and 324. This difference of projection may be any suitable value, and typically will be on the order of 0.0005 inch (12 microns) to about 0.0025 inch (50 microns). In other words, rear razor blade strips 321 and 323 advantageously extend farther into and/or through the working plane so they have greater exposure, in order to produce an enhanced shaving action. This strategy of having the rearward blade edge slightly more exposed or elevated relative to the working plane of a twin razor blade set is also taught, for example, in my earlier U.S. Pat. No. 5,522,137 for bi-directional razor blade heads (see FIG. 22 and accompanying text) on T-bar razor handles.

In operation, a user places his or her thumb on surface 311 of handgrip 304 and wraps his or her fingers around opposed surfaces 307 and 308 of handgrip 304. Then, as with the other embodiments, the respective working planes 331 and 333 of bi-directional head 301 are successively moved across the skin to be shaved in first and second opposite directions, just as was described for the second embodiment.

When the razor blade strips of head 301 become dull or spent, the user may replace head 301 by grabbing suitable non-cutting base portion 335 and sliding head 301 off of proximal end 303 of handle 302. To do this, a user firmly holds handgrip 304, and forces head 301 in the direction of arrow 312 by pressing against exterior end surfaces 336 and 337 of, and/or by gripping and tugging on exterior side surfaces 348 and 349 of, base portion 335. Head 301 can then be replaced with another new identical head having fresh razor blade strips.

Figure 21:
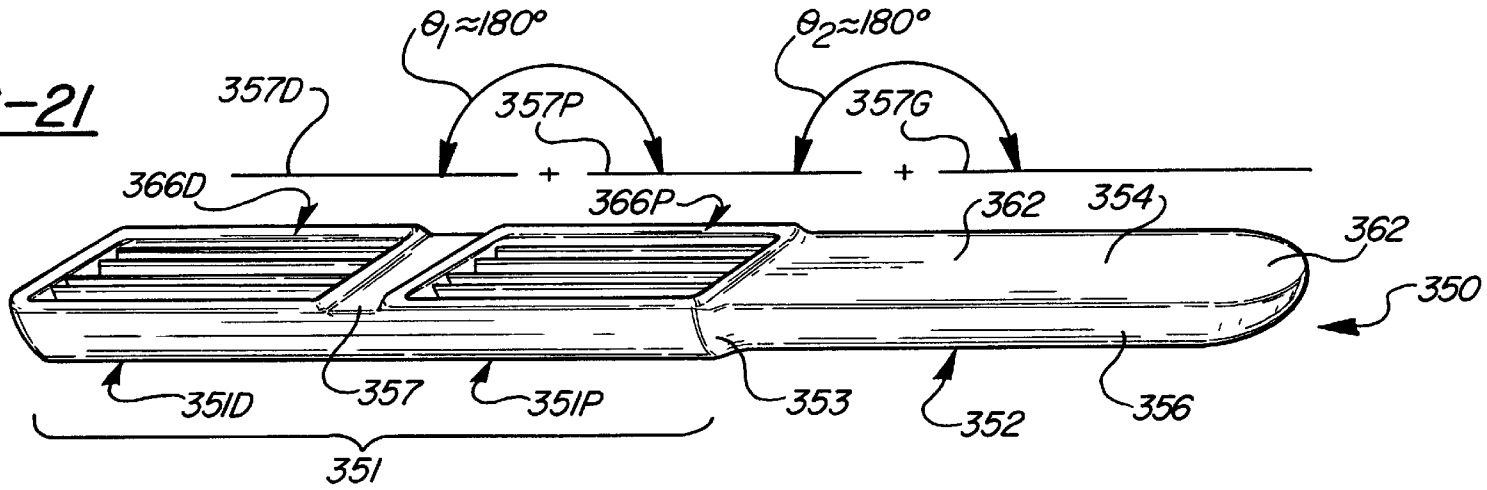
FIGS. 21 and 22 illustrate a sixth embodiment of an in-line bi-directional razor blade device having two complete bi-directional razor blade head portions arranged end-to-end in a common plane, where.
Figure 22:
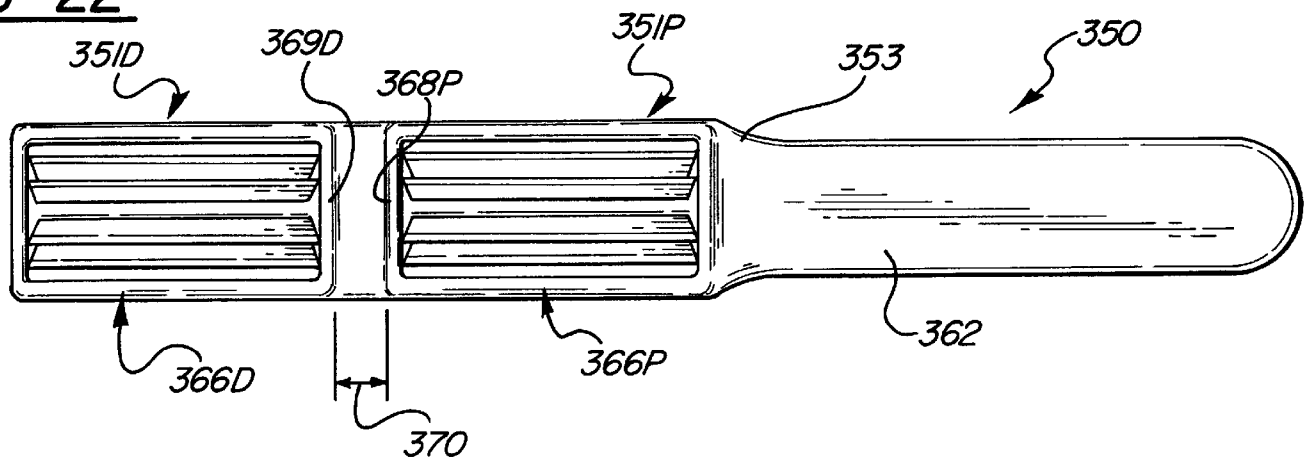

FIGS. 21 and 22 show the sixth embodiment of my invention, namely in-line bi-directional shaving device 350 which includes a razor blade shaving head structure 351 with two complete bi-directional razor blade head portions 351D and 351P arranged end to end, that is in-line with each other, and also in-line with elongated handle 352. (The suffix D stands for "distal" to the near end of handle 352 and user's hand, while the suffix P stands "proximal" to the near end of handle 352 and user's hand.) In terms of construction, the individual elongated razor blade head portions and handle are identical to the fourth embodiment shown in FIGS. 12–16. Briefly, handle 352 includes neck portion 353 and handgrip 354. Handgrip portion 354 includes an upper flat surface 362, rounded distal end 365 and a flattened semi-circular surface 356 opposite flat face 362. Head portions 351D and 351P respectively include blade edge guarding systems 366D and 366P. A plain base portion segment 357 separates the two closest end guard portions 369D and 368P from one another. This portion 357 has a longitudinal dimension 370 shown in FIG. 22, which may be any suitable dimension, for example, from about 0.1 inch (2.5 mm) to about 0.4 inch (10 mm) or more.

Lines 357D and 357P respectively represent the relative orientation of working planes of razor heads 351D and 351P. Line 357G represents the relative orientation of the plane of the top surface 362 of handgrip 354. As shown by angle $\theta_1$=180°, these two working planes are preferably aligned with one another, that is co-planar. Also, as shown by angle $\theta_2$=180°, these working planes are also preferably substantially co-planar with the flat face 362 of handle 352.

The benefit of shaving device 350 is that it may be used to effectively shave larger areas of skin more quickly than an in-line bi-directional shaving device, like device 250, having only one bi-directional razor head 251. If desired, the handle 354 may be offset rearwardly from the working planes of head portions 366D and 366P, in the same manner that the handles of the FIG. 1 and FIG. 6 embodiments are shown offset from (or alternative ways in which they may be offset from) their respective bi-directional razor blade heads. For reasons previously explained, it is preferable that the longitudinal axes of head portions 351D and 351P be kept parallel with the longitudinal axis of handle 352.

Figure 23:
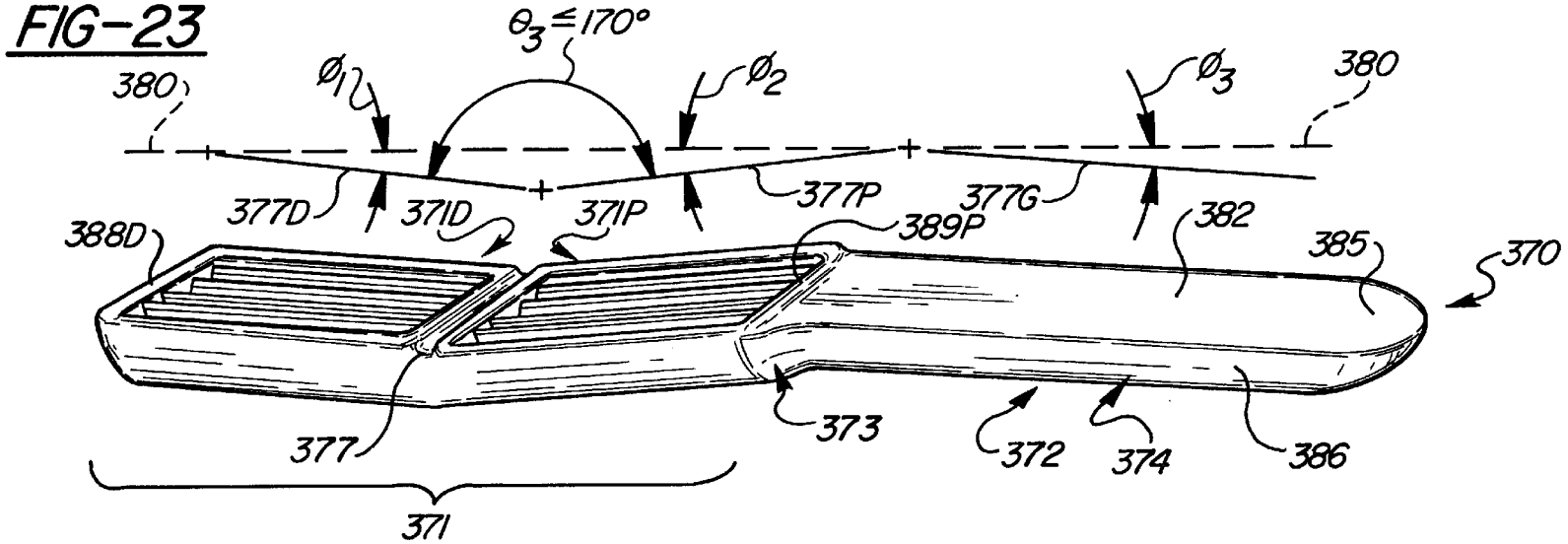
FIGS. 23 and 24 illustrate a seventh embodiment of the present invention similar to the sixth embodiment but with the two bi-directional razor head portions sloped inwardly relative to one another, as shown, where.
Figure 24:
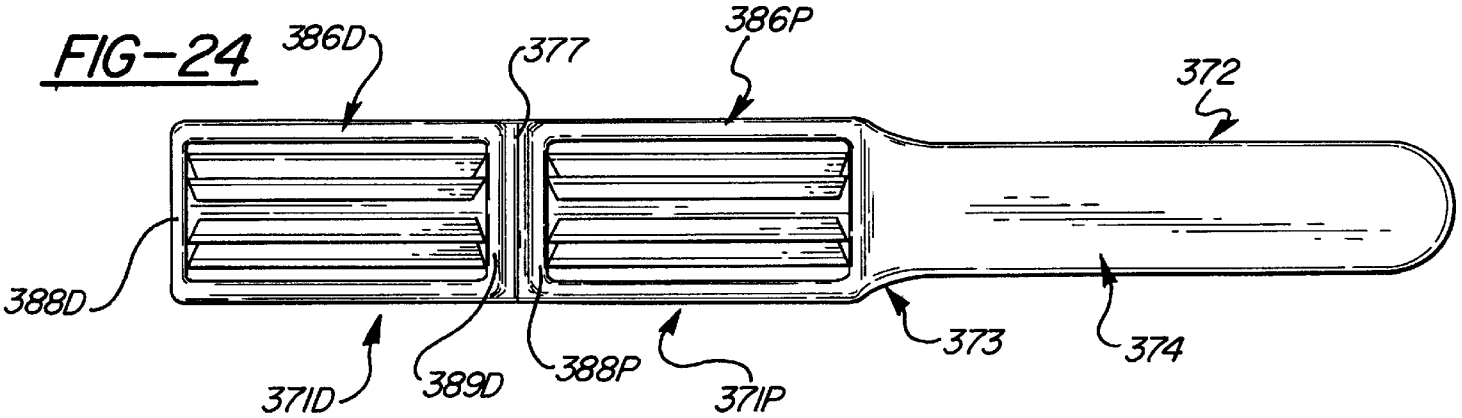

FIGS. 23 and 24 show the seventh embodiment of my invention, namely in-line bi-directional shaving device 370 which includes an extra long head structure 371 with two complete elongated bi-directional razor blade head portions 371D and 371P arranged end-to-end, in-line with each other and with elongated handle 372. In terms of construction, the individual elongated razor blade head portions and handle are identical to the fourth embodiment shown in FIGS. 12–16. Also, the construction of this embodiment is identical to the sixth embodiment, with the exception that the individual head portions 371D and 371P slope inwardly toward one another, and handle 372 slopes slightly away, as will now be further explained.

Briefly, handle 372 includes neck portion 373 and handgrip 374. Handgrip portion 374 includes an upper flat surface 382, rounded distal end 385 and a flattened semicircular surface 386 opposite flat face 382. Head portions 371D and 371P respectively include rectilinear blade edge guarding systems 386D and 386P. A plain base portion segment 377 may still separate the two closest end guard portions 389D and 388P from one another, just like plain portion 357 in FIG. 22.

Lines 377D, 377P and 377G respectively represent the relative orientations of working planes of razor heads 371D and 371 P. As shown by angle $\theta_3 \leqq 170°$, these two working planes are preferably longitudinally tilted inwardly toward one another. Dashed line 380 represents an overall longitudinal plane formed even with the top exposed surfaces of the two outer end guard portions 388D and 389P. This plane 380 is thus parallel to the overall major longitudinal axis (not shown) of device 370. The angle $\phi_1$ and the angle $\phi_2$ further illustrate the angles of inclination of the two razor heads and their respective working planes relative to this overall longitudinal plane. Any suitable value of the angle $\theta_3$ that is desired may be used for this inward inclination. Preferably this angle $\theta_3$ is less than or equal to about 170°, with values for $\theta_3$ of between 100° and 170° being preferred, and with a value for $\theta_3$ between 120° and 165° being most preferred. Also, the magnitude of angle $\phi_1$ and of angle $\phi_2$ are preferably equal, or substantially equal, such as within ten degrees of one another. If desired, handle 372 may be offset, like the handles in the first and second embodiments are relative to their razor blade heads. Or handle 372 may be inclined by tilting it toward the exposed razor blade strips (not shown), or by tilting it away from the longitudinal axis of device 370. This latter condition is shown, and angle $\phi_3$ represents the angle of inclination of the handle relative to plane 380. Angle $\phi_3$ may be any suitable value, such as about 0° to about 45°. If an inclined handle is to be used, I prefer that angle $\phi_3$ be made equal to angle $\phi_1$ and/or angle $\phi_2$, and that each of these angles be kept equal to about 35° or less.

A benefit of shaving device 370 is that it may be used to more quickly shave areas of skin on curved limbs, such as the arms and legs, than even two-headed in-line shaving device 350. This is because razor blade device 370, when used to stroke up-and-down along a limb, such as an arm or leg, will bear against the skin to be shaved with two different transverse lines of shaving contact on the skin simultaneously. Thus, since two stripes of skin will be shaved simultaneously when shaving with device 370, this device may well be substantially faster man shaving with a single-head in-line bi-directional shaving device of the type shown, for example, in the first three embodiments herein.

I prefer to see handle 372 kept parallel to plane 380, so as to make handle 372 axially in-line with the major longitudinal axis of shaving device 370. I believe this arrangement makes it easiest for a user to have (or to quickly develop) a good sense for those precise areas of the curved skin surfaces to which the razor blades of the two heads 371D and 371P are tangent, thereby allowing the user to more accurately guide and control the simultaneous shaving action of the twin razor heads 371D and 371P.

Bi-directional Shaving Methods. Having described my seven exemplary embodiments of the in-line bi-directional razors of the present invention, it is now useful to summarize the shaving methods associated with the different classes of embodiments of my in-line bi-directional razor shaving devices.

In order to shave, either rapidly or slowly if desired, with any one of my in-line bi-directional razors, the user holds the device by the handle in the normal manner in which he or she might grasp and hold a hair brush, or a small stick used for pointing. The user grasps the razor handle and contacts the face portion of the razor head adjacent the skin portion to be shaved. For example, the razor head is shown placed against the skin. The user may stroke the razor first in one direction, and then, at the end of the stroke, reverse the movement to stroke in the opposite direction. This back-and-forth motion is indicated by the arrows adjacent the handle and the head in FIG. 32. Thus, no special grip and no unnatural motion is required to shave bi-directionally with my new manual in-line bi-directional razors. In other words, the required back and forth shaving technique is performed with a grip style very similar to the user's previous experience with uni-directional T-bar manual safety razors which used to shave one's face or legs. The required back and forth motion of the arm is a natural, comfortable motion. Anyone who has rubbed a cleaning cloth back and forth along a surface, or rubbed an eraser against the blackboard, or performed any like task, has often performed this kind of to and fro movement.

One of the advantages of my single-plane in-line bi-directional razor blade shaving devices is that they need not be tilted, or lifted, or repositioned for the return strokes or to cut in an opposite direction, as is the practice with a normal uni-directional razor. Hence, my bi-directional razors may simply be moved back-and-forth, fairly rapidly, to complete the shaving process bi-directionally and expeditiously.

Some of my in-line shaving devices have two distinct working planes with a significant angle between the two half faces, and thus working planes. These are the second, third and fifth embodiments. To use these two-working plane devices, the user grips the razor handle of the device in the same manner as those which have only a single working plane. The user still moves the handle in the same manner as well after the razor has been placed against the skin. Most importantly, the user can stroke and cut hair in both directions without lifting the two-plane in-line razor head from the skin, or changing either the hand's position or grip with the fingers and thumb on the handle as the direction of razor head travel is changed.

For my two working plane embodiments, the user will have to incorporate a slight twisting motion of the razor head at the end of each stroke, or at the beginning of the next stroke, in order to place the other working plane into contact with the skin to be shaved as the razor blade head is moved in a second direction. In other words, upon a reversal of direction, one shaving zone or working plane of the razor head will have to come off of the skin, and the other working plane will have to engage the skin as the direction of razor head travel is reversed.

As noted earlier, In the single plane embodiments of my in-line bi-directional razor shaving devices, the set of razor blade strips pointing away from the direction of travel are not actually cutting hair; rather they are being dragged along the skin, and are functioning as part of the rear guard and as rear glide means. The use of one of two metal razor blade strips at an angle anywhere between close to zero degrees up to about 20 degrees from the horizontal, over even up to 35 degrees from the horizontal provides a smooth stable rear glide surface that helps define the working plane of the forward razor blade strips actually involved in the cutting of hair.

It should be appreciated that most if not all of my in-line bi-directional razor shaving devices, particularly those which are assembled devices made from components that can be mass-produced, lend themselves to being efficiently constructed and economically mass-produced using current manual safety razor construction and automated assembly techniques. In particular, all molded plastic components can all be made from conventional plastic material using available molding machinery with dies that have been machined to produce finished parts. The blade strips and blade spacers, if desired, both with their registration holes, can be made using conventional equipment. Special tooling can easily be made to allow my in-line bi-directional razor blade shaving devices to be automatically assembled using conventional equipment at very low cost.

Preferred Dimensions. Many of my in-line bi-directional razors shown in the Figures and described here are preferably sized and configured to be aesthetically pleasing, well-balanced, and comfortable to hold and use. Due to the need to be able to emphasize and clearly show key features under discussion, the Figures are not always shown to scale. As can be seen from the Figures, however, the overall size of a number of my in-line bi-directional razor designs will very likely be regarded by a typical user of a wet razor as being really not much bigger or heavier, than the existing uni-directional wet razor he or she may be using. The size, weight, balance and overall appearance of my in-line bi-directional razor designs should be readily accepted by consumers and by workers in medical facilities and care givers in assisted-living situations. Further, once the distinct advantages of in-line bi-directional razors and shaving methods are appreciated by consumers, such in-line bi-directional razors may well achieve widespread use, even by barbers, stylists or others having need to shave other individuals.

Epilogue. The term "razor blade strip" as used herein, including the claims, encompasses any elongated blade device having a razor-sharp edge, no matter how constructed, and no matter whether flat or angled. Thus, this term covers blade strips made of a single piece of metal or other sharpened or sharpenable material. It also covers razor blade strips made by bonding a thin gauge strip of metal to a more rigid piece of metal, by laser spot welding or the like, like the blades used in the Gillette Sensor and Gillette Mach3 razors.

While the foregoing embodiments have all been described with respect to the razor blade edges pointing outwardly, my in-line bi-directional shaving device devices can be constructed with the razor blade edges pointed inwardly, that is toward each other, rather than outwardly. In other words, the sharpened edges of the first and second sets of the razor blade strips would be generally point inwardly, that is generally toward one another, while still being at an acute angle relative to their respective working plane. In other words, I definitely would not want the razor blade strips pointing directly at one another; instead the rigid blade strips would need to remain at an acute angle relative to the common working plane, or in those embodiments having inwardly pointing razor blades, with two distinct working planes, the working planes should still be at an angle relative to one another, with the planes with the working plane facing generally away from one another. Although this inwardly-pointing construction is not preferred, it nonetheless will work. Accordingly, the broader aspects of the invention as claimed below, which are not limited to in-line shaving devices having outwardly-pointing razor blade strips, should be understood to apply to such inwardly-pointing opposed razor blade constructions of the in-line bi-directional shaving devices of the present invention.

It should be appreciated that my in-line bi-directional razor heads may be used with conventional razor blade handles the commercially available, provided that inappropriate handle-to-head coupling mechanism, including any return-to-center mechanism which may be required or desirable, is also furnished. Also, a series of spaced parallel fine protective wire segments arranged over the razor-sharp edges of the razor blade strips, as taught for example in U.S. Pat. Nos. 5,063,668 and 5,579,580 to Althaus, or as found in the commercially available Schick razor blade shaving devices for women, may be used to further protect the skin against accidental cuts or scrapes. These protective wires may be incorporated into any of the bi-directional razor heads or uni-directional half-heads of my in-line razor blade devices, if desired. Those in the art should appreciate that my in-line bi-directional razor blade shaving devices may also be constructed from flexible razor heads (including but not limited to the flexible cartridge disclosed in FIGS. 40 through 42 of my U.S. Pat. No. 5,522,137), as well as from rigid elongated bi-directional razor heads and cartridges that are shown herein.

A number of other possible modifications have already been described above. Further changes are clearly possible, as different features and aspects of one embodiment may be combined with another embodiment to provide an in-line bi-directional shaving device with the desired features from both. Thus, it is to be understood that the present invention is by no means limited to the particular constructions herein disclosed and/or shown in the drawings. Instead, the present invention also encompasses any modifications or equivalents within the scope of the disclosures that are fairly covered by the claims set forth below.

I claim:

1. An in-line bi-directional manual shaving razor blade device for bi-directional rapid-shaving of large skin areas of a person's body, including legs and arms, the device comprising:

an elongated single razor head having first and second front guard portions spaced from one another and respectively including first and second longitudinal edges which define a front guard plane, and a face and a central longitudinal axis, both generally located between the longitudinal edges, the razor head being generally symmetrical about a plane of symmetry perpendicular to the front guard plane, the central longitudinal axis of the razor head being located within the plane of symmetry, the razor head having first and second working planes generally arranged along the face of the razor head, and respectively defined in part by the first and second front guard portions;

an elongated handle structure connected to and supporting the razor head for manual movement by a user of the razor blade device, the handle structure having an elongated handgrip portion provided with and centrally arranged along a principal axis that is generally located in the plane of symmetry, the handgrip portion generally extending outwardly away from the razor head;

a first elongated razor blade strip supported by the head and having a sharpened blade edge portion extending outwardly at an acute angle relative to the face and projecting generally toward the first longitudinal edge and away from the central longitudinal axis of the razor head, the blade edge portion including a straight elongated razor-sharp edge generally positioned in the first working plane; and a second elongated razor blade strip supported by the head and having a sharpened blade edge portion extending outwardly at an acute angle relative to the face and projecting generally toward the second longitudinal edge and away from the central longitudinal axis of the razor head, the blade edge portion including a straight elongated razor-sharp edge generally positioned in the second working plane;

the handgrip portion of the razor handle structure being arranged to be manually grasped and for moving the handle structure so that the razor head moves in a first direction along a user's skin that is generally perpendicular to the principal axis of the handle, in order to shave hair extending from the skin while moving in the first direction using the straight razor-sharp edge of the first razor blade strip with at least the first working plane being in substantially tangential contact with the skin to be shaved, and then, for reversing the direction of movement of the handle structure so that the razor head moves in a second direction along a user's skin that is opposite the first direction, in order to shave hair extending therefrom using the straight razor-sharp edge of the second razor blade strip with at least the second working plane being in substantially tangential contact with the skin to be shaved, without the need to lift the razor head from the user's skin during movements in the opposite directions, to for the user to change the user's grasp on the handgrip portion during movements in the opposite directions;

whereby the user of the in-line razor blade device may rapidly move the bi-directional razor head back and forth along the skin to be shaved, and in so doing have at least one of the working planes of the razor head in contact with the skin while shaving in the first and second directions.

2. An in-line shaving device as in claim 1, wherein:

the razor head has first and second end portions extending generally transversely to the central longitudinal axis of the razor head, each of the straight razor-sharp edges of the razor blade strips are continuous elongated edges extending along substantially the entire length of razor blade strip between the first and second end portions of the razor head, and the handle structure is connected to and supports the razor head from the first end thereof, and the handle structure is arranged so that the principal axis of the handgrip portion thereof is generally parallel to the central longitudinal axis of the razor head.

3. An in-line shaving device as in claim 1, wherein the first and second working planes are substantially co-planar and substantially identical in location to the front guard plane, whereby a user need not rotate the handle structure as the razor blade device is moved back and forth along the user's skin.

4. An in-line shaving device as in claim 1, wherein:

the razor head includes a centrally located elongated rear guard portion disposed parallel to the central longitudinal axis of the razor head, the rear guard portion having first and second surface sections, and the first working plane is defined in part by the first surface section of the elongated rear guard portion, and the second working plane is defined in part by the second surface section of the elongated rear guard portion.

5. An in-line shaving device as in claim 4, wherein the elongated rear guard portion is elevated with respect to the front guard plane, such that the first and second working planes intersect one another at an included angle of more than about ten degrees.

6. An in-line shaving device as in claim 4, wherein:

the elongated rear guard portion is substantially located only slightly above the front guard plane, such that the first and second working planes intersect one another at a sufficiently small included angle of less than about ten degrees, whereby a user need not rotate the handle structure as the razor blade device is moved back and forth along the user's skin, since the first and second working planes normally engage the skin as the razor head is stroked respectively in the first and second directions.

7. An in-line shaving device as in claim 1, wherein the handle structure has a neck portion generally located between the elongated handgrip portion and the razor head, the neck portion being arranged to connect the razor head to the handgrip portion.

8. An in-line shaving device as in claim 7, wherein the neck portion of the handle structure is symmetrically arranged about the plane of symmetry and generally extends in a direction that is transverse to the longitudinal axis of the razor head.

9. An in-line shaving device as in claim 7, wherein the neck portion has a principal axis which is generally arranged at a transverse angle to the principal axis of the handle structure.

10. An in-line shaving device as in claim 7, wherein the principal axis of the handle structure is generally in line with the central longitudinal axis of the razor head.

11. An in-line shaving device as in claim 1, wherein the principal axis of the handle structure is generally parallel to the central longitudinal axis of the razor head.

12. An in-line shaving device as in claim 1, wherein the handgrip portion of the handle structure along most of its length has a transverse cross-section that is symmetrical about the plane of symmetry, and that is substantially continuously increasing as the distance from the razor head increases.

13. An in-line shaving device as in claim 1, wherein:

the handgrip portion of the handle structure along most of its length has at least a first exterior surface that is generally planar, and is arranged generally parallel to the front guard plane of the razor head.

14. An in-line shaving device as in claim 1, wherein:

the handgrip portion of the handle structure along most of its length has at least first and second exterior surfaces spaced from one another and generally arranged respectively along first and second exterior planes, which exterior planes are arranged substantially orthogonally to the front guard plane of the razor head.

15. An in-line shaving device as in claim 1, wherein the handle structure along at least most of its length has a cross-section perpendicular to the principal axis of the handle structure that is generally elongated, and the handle structure has a principal plane that is generally parallel to the front guard plane of the razor head.

16. An in-line shaving device as in claim 1, wherein the handgrip portion of the handle structure along at least most of its length has an outer shape when viewed in cross-section perpendicular to its principal axis that is a regular shape selected from the group of regular shapes consisting of rectangles, circles, ovals, triangles and trapezoids.

17. An in-line shaving device as in claim 1, further comprising:

a third razor blade strip supported by the razor head and provided with a sharpened edge portion substantially identical in length to the sharpened edge portion of the first razor blade strip and extending in the substantially same direction, and including an elongated razor-sharp edge generally positioned in the first working plane, the sharpened edge portion of the third blade strip being arranged to be closely adjacent to and spaced a short distance from the sharpened edge portion of the first blade strip so that the first and third blade strips cut hair substantially simultaneously as the razor head is moved in the first direction along the user's skin; and a fourth razor blade strip supported by the razor head and provided with a sharpened edge portion substantially identical in length to the sharpened edge portion of the second razor blade strip and extending in the substantially same direction, and including an elongated razor-sharp edge generally positioned in the second working plane, the sharpened edge portion of the fourth blade strip being arranged to be closely adjacent to and spaced a short distance from the sharpened edge portion of the second blade strip so that the second and fourth blade strips cut hair substantially simultaneously as the razor head is moved in the second direction opposite the first direction along the user's skin.

18. An in-line shaving device as in claim 17, wherein:

the razor head has first and second end portions extending generally transversely to the central longitudinal axis of the razor head, each of the razor-sharp edges of the first through fourth razor blade strips are continuous elongated straight edges extending along substantially the entire length of its respective razor blade strip between the first and second end portions of the razor head, the handle structure has a neck portion generally located between the elongated handgrip portion and the razor head, the neck portion connecting the head to the handgrip portion, and the handle structure is arranged so that the principal axis of the handgrip portion is generally parallel to the central longitudinal axis of the razor head.

19. An in-line shaving device as in claim 18, wherein:

the neck portion of the handle structure is generally arranged along its own central axis that extends in a direction that is transverse to the longitudinal axis of the razor head and to the principal axis of the handle structure, such that the longitudinal axis of the razor head is laterally offset from the principal axis of the handle structure, and the front guard portions of the razor head are arranged to help smooth and stretch the skin prior to the skin being shaved.

20. An in-line shaving device as in claim 17, wherein:

the razor-sharp elongated edge of the first and third razor blade strips are arranged at slightly different elevations relative to the first working plane, such that the razor-sharp edge of the first razor blade strip sits lower in relation to the first working plane than the razor-sharp edge of the third razor blade strip, and the razor-sharp elongated edge of the second and fourth razor blade strips are arranged at slightly different elevations relative to the second working plane, such that the razor-sharp edge of the second razor blade strip sits lower in relation to the second working plane than the razor-sharp edge of the fourth razor blade strip, whereby the razor-sharp edge of the third razor blade strip projects very slightly further toward a user's skin than does the razor-sharp edge of the first razor blade strip, and whereby the razor-sharp edge of the fourth razor blade strip projects very slightly further toward a user's skin than does the razor-sharp edge of the second razor blade strip.

21. An in-line shaving device as in claim 1, wherein the handle structure and the razor head are permanently attached to one another.

22. An in-line shaving device as in claim 21, wherein at least part of the handle structure and at least part of the razor head are integrally formed of the same molded plastic material.

23. An in-line shaving device as in claim 1, wherein:

the razor head and handle structure each include connection portions arranged for removably connecting the razor head and handle structure to one another, whereby, when the razor blade strips of the razor head are dulled with use, the razor head may be removed from the handle structure and replaced with a substantially identical razor head having fresh razor blade strips.

24. An in-line shaving device as in claim 23, wherein:

the razor head has a base portion generally opposite of the face of the razor head, the base portion including the connection portion arranged below the front guard plane of the razor head, the connection portion being provided with at least one socket portion for receiving at least part of the connection portion of the handle structure; and the connection portion of the handle structure is located at a proximal end of the handle structure and includes at least one male portion complementary to the socket portion and receivable at least partially therein.

25. An in-line shaving device as in claim 1, wherein:

the razor head includes an elongated bi-directional razor blade cartridge and a base portion connected to the handle structure, the base portion is provided with a cartridge connection mechanism for receiving and supporting the cartridge, the cartridge includes the first and second razor blade strips and a platform structure arranged for supporting the first and second razor blade strips, and the platform structure including a base-connecting mechanism which interlockingly engages with the cartridge connection mechanism of the base portion.

26. An in-line shaving device as in claim 1, wherein:

the razor head has first and second elongated single-direction razor blade cartridges and a base portion connected to the handle structure, the base portion including first and second cartridge connection mechanisms for respectively supporting the first and second elongated single-direction cartridges, the first cartridge being provided with and supporting at least the first razor blade strip, and having a base-connecting mechanism which interlockingly engages with the first cartridge connection mechanism, the second cartridge being provided with and supporting at least the second razor blade strip, and having a base-connecting mechanism which interlockingly engages with the second cartridge connection mechanism, and the first and second elongated cartridges respectively having first and second elongated central axes which are substantially parallel to and located on opposite sides of the central longitudinal axis of the razor head.

27. An in-line shaving device as in claim 26, wherein:

the first single-direction razor blade cartridge includes the first front guard portion and a first rear guard portion, and the second single-direction razor blade cartridge includes the second front guard portion and a second rear guard portion.

28. An in-line shaving device as in claim 27, wherein:

the first and second single-direction razor blade cartridges each include a lubricant strip located immediately adjacent to their respective rear guard portions.

29. An in-line shaving device as in claim 1, wherein:

the razor head includes first and second substantially identical elongated uni-directional razor head portions respectively provided with the first and second razor blade strips and blade-strip support structures arranged for respectively supporting the first and second razor blade strips, the uni-directional razor head portions being physically separate from one another, and each having a support connection mechanism, and the razor head includes a base portion provided with first and second connector mechanisms for respectively receiving the support connection mechanisms of the first and second uni-directional head portions.

30. An in-line shaving device as in claim 29, wherein:

the uni-directional razor head portions are constructed as removable razor cartridges.

31. An in-line shaving device as in claim 30, wherein:

the first uni-directional razor head portion includes at least one other razor blade strip provided with a sharpened edge portion substantially identical in length to the sharpened edge portion of the first razor blade strip and extending in the substantially same direction, and including an elongated razor-sharp edge generally positioned in the first working plane, the sharpened edge portion of this at least one other blade strip being arranged to be closely adjacent to and spaced a short distance from the sharpened edge portion of the first blade strip so that it and the first blade strip cut hair substantially simultaneously as the razor head is moved in the first direction along the user's skin; and the second uni-directional razor head portion includes at least one other razor blade strip provided with a sharpened edge portion substantially identical in length to the sharpened edge portion of the second razor blade strip and extending in the substantially same direction, and including an elongated razor-sharp edge generally positioned in the second working plane, the sharpened edge portion of this at least one other blade strip being arranged to be closely adjacent to and spaced a short distance from the sharpened edge portion of the second blade strip so that it and the second blade strip cut hair substantially simultaneously as the razor head is moved in the second direction along the user's skin.

32. An in-line shaving device as in claim 31, wherein:

the uni-directional razor head portions are each constructed with identical dual razor blade strips, and each razor-sharp edge of each blade strip is straight along all of its exposed length.

33. An in-line shaving device as in claim 31, wherein:

the first and second uni-directional head portions respectively have first and second face portions that include substantially flat surface areas on their respective front and rear guard portions, which pairs of front and rear portions correspond to the first and second working planes, the first and second face portions being sufficiently tilted away from one another, such that the first and second working planes are respectively defined solely by the first and second uni-directional head portions.

34. An in-line shaving device as in claim 31, wherein:

the first and second uni-directional head portions are respectively constructed as removable cartridges, whereby, when the razor blade strips of a given head portion are dulled with use, that razor head portion may be removed from the handle structure and replaced with a substantially identical razor head having fresh razor blade strips.

* * * * *

UNITED STATES PATENT AND TRADEMARK OFFICE

CERTIFICATE OF CORRECTION

PATENT NO. : 6,082,007
DATED : July 4, 2000
INVENTOR(S) : Edward A. Andrews

It is certified that error appears in the above-identified patent and that said Letters Patent is hereby corrected as shown below:

Title page,
Item [63], Related U.S. Application Data,
Line 8, replace "5, 856,189" with -- 5,865,198 --.

Column 1,
Line 10, replace "5,856,189" with -- 5,865,189 --.

Column 10,
Line 1, after "third" insert -- , --.
Line 59, replace "with" with -- which --.

Column 13,
Line 44, after "is" insert -- a --.

Column 16,
Line 17, replace "FIG. 3" with -- FIG. 4 --.

Column 19,
Line 2, replace "FIGS. 3" with -- FIG. 3 --.
Lines 24 and 31, replace "too" with -- to --.

Column 20,
Line 16, replace "151" with -- 161 --.

Column 23,
Line 19, after "head" delete "it".
Line 53, replace "247 and 248" with -- 246 and 247 --.
Line 65, replace "of" (2nd occurrence) with -- as --.
Line 66, repalce "FIG." with -- FIGS. --.

Column 24,
Line 55, repalce "FIG." -- FIGS. --.

Column 25,
Line 8, replace "been" with -- being --.
Line 19, replace "maybe" with -- may be --.

Column 26,
Line 47, replace "=" with -- ≈ --.

UNITED STATES PATENT AND TRADEMARK OFFICE

CERTIFICATE OF CORRECTION

PATENT NO. : 6,082,007
DATED : July 4, 2000
INVENTOR(S) : Edward A. Andrews

It is certified that error appears in the above-identified patent and that said Letters Patent is hereby corrected as shown below:

Column 27,
Line 52, replace "stripes" with -- strips --.
Line 54, replace "man" with -- than --.

Column 28,
Line 21, after "which" insert -- are --.
Line 60, replace "In" with -- in --.

Column 29,
Line 51, delete "devices".
Line 55, delete "be".

Column 30,
Line 8, replace "the" with -- that are --.

Column 31, claim 1,
Line 31, delete "to".

Column 35, claim 30,
Line 34, after "cartridges" insert -- , whereby the razor cartridges may be replaced with new razor cartridges --.

Signed and Sealed this

Ninth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,082,007
DATED : July 4, 2000
INVENTOR(S) : Andrews

It is certified that error appears in the above-identified patent and that said Letters Patent is hereby corrected as shown below:

Column 35,
Line 34, after "cartridges" insert -- , whereby the razor cartridges may be replaced when spent with new razor cartridges --.

Signed and Sealed this

Fourteenth Day of May, 2002

*Attest:*

*Attesting Officer*

JAMES E. ROGAN
*Director of the United States Patent and Trademark Office*